US005482390A

United States Patent [19]

Murakami et al.

[11] Patent Number: 5,482,390

[45] Date of Patent: Jan. 9, 1996

[54] PRINTER HAVING DISCHARGE ROLLERS

[75] Inventors: Kenjiro Murakami; Toshikazu Kotaka; Hiroshi Ishida; Kiyoto Komuro; Yoshiaki Nakayama; Nobuhito Takahashi; Satoshi Takehana, all of Nagano, Japan

[73] Assignee: Seiko Epson Corporation, Tokyo, Japan

[21] Appl. No.: 354,799

[22] Filed: Dec. 12, 1994

Related U.S. Application Data

[62] Division of Ser. No. 994,293, Dec. 21, 1992, Pat. No. 5,397,191.

[30] Foreign Application Priority Data

| | | | |
|---|---|---|---|
| Dec. 20, 1991 | [JP] | Japan | 3-356023 |
| Jan. 29, 1992 | [JP] | Japan | 4-13651 |
| Jan. 29, 1992 | [JP] | Japan | 4-13655 |
| Mar. 10, 1992 | [JP] | Japan | 4-51598 |
| Mar. 10, 1992 | [JP] | Japan | 4-51602 |
| Mar. 10, 1992 | [JP] | Japan | 4-51604 |
| Apr. 3, 1992 | [JP] | Japan | 4-82289 |
| Apr. 7, 1992 | [JP] | Japan | 4-85537 |
| Apr. 7, 1992 | [JP] | Japan | 4-85538 |

[51] Int. Cl.[6] ..... B41J 13/036

[52] U.S. Cl. ..... 400/636.2; 400/636.3; 400/636

[58] Field of Search ..... 400/578, 629, 400/636.2, 636.3, 636, 641

[56] References Cited

U.S. PATENT DOCUMENTS

| | | | |
|---|---|---|---|
| 4,848,944 | 7/1989 | Fuller et al. | 400/629 |
| 5,030,025 | 7/1991 | Mitcham et al. | 400/636 |
| 5,294,204 | 3/1994 | Clary | 400/636.2 |
| 5,368,403 | 11/1994 | Broder et al. | 400/636.3 |

FOREIGN PATENT DOCUMENTS

| | | | |
|---|---|---|---|
| 3240575 | 10/1991 | Japan | 400/636.3 |

*Primary Examiner*—Ren Yan
*Assistant Examiner*—John S. Hilten
*Attorney, Agent, or Firm*—Sughrue, Mion, Zinn, Macpeak & Seas

[57] ABSTRACT

A printer which is compact, can accurately supply paper and has reduced noise characteristics. Additionally, the printer enables easy correction of paper jams and can be selectively operated in various modes according to the user's preference. The printer includes a paper feed roller which is pivotable between a paper feed position and a non-feeding position, a drive force transmitting mechanism for transmitting a drive force to the paper feed roller, a carriage reciprocatively movable along the width of the paper fed by the paper feed roller, and an intermediate transmission mechanism attached to the side of the carriage. Only when the carriage is in a stand-by position, the intermediate transmission mechanism couples with the drive force transmitting mechanism to transmit to the paper feed roller a paper-feed directional rotating force so as to rotate the paper feed roller to the paper feed position. The intermediate transmission mechanism is preferably an idler rotatably mounted on the side of the carriage. The paper feed roller is preferably driven through a planetary gear mechanism including a sun gear provided on a drive shaft, a paper-feed roller holder rotatably mounted on the drive shaft, and a planetary gear coaxially provided with the paper feed roller supported with the paper-feed roller holder.

3 Claims, 30 Drawing Sheets

FIG. 25B
FIG. 25C
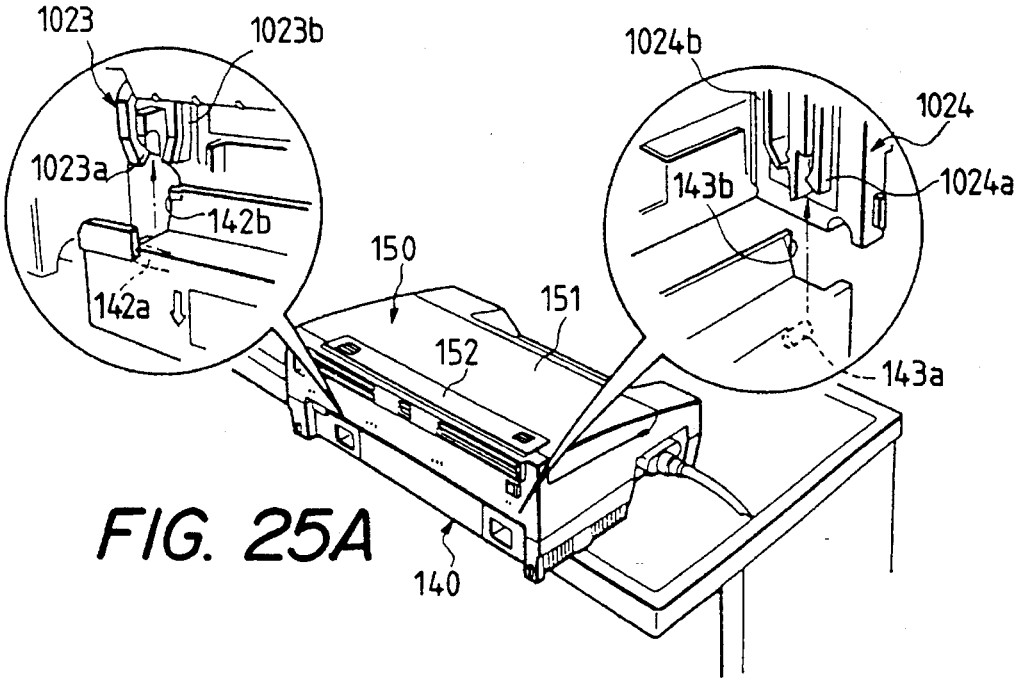
FIG. 25A
FIG. 27
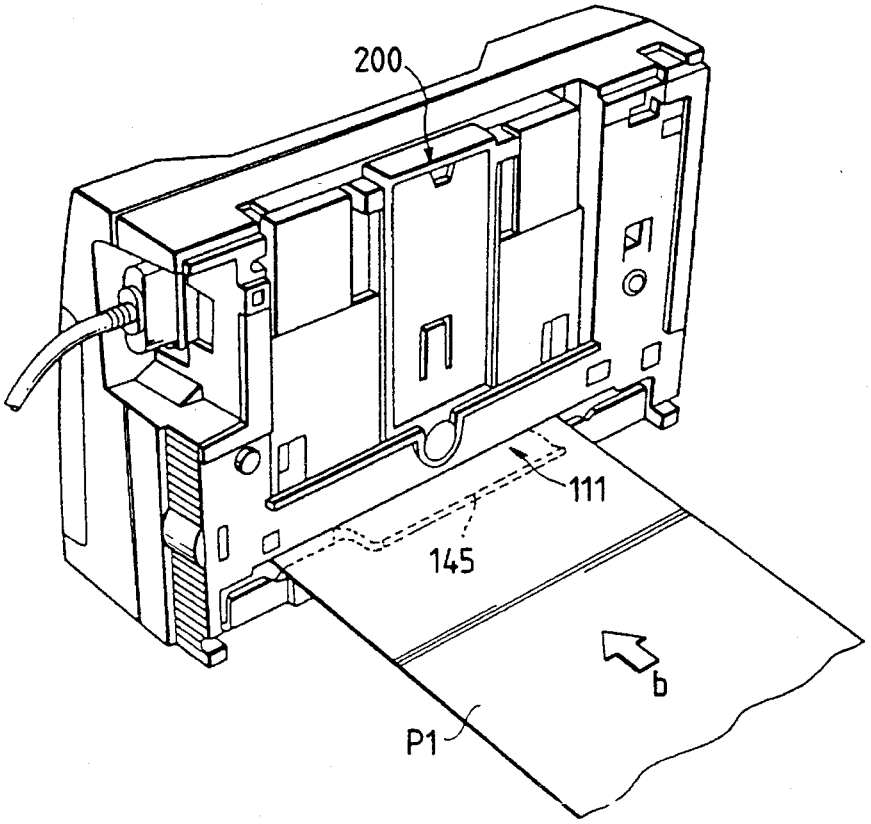

FIG. 28
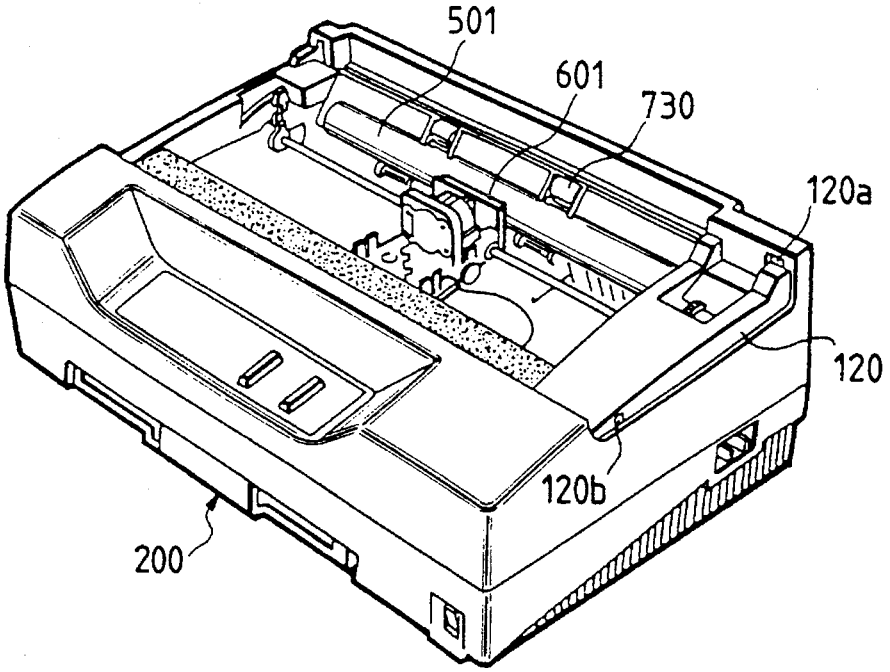
FIG. 29B
FIG. 29A
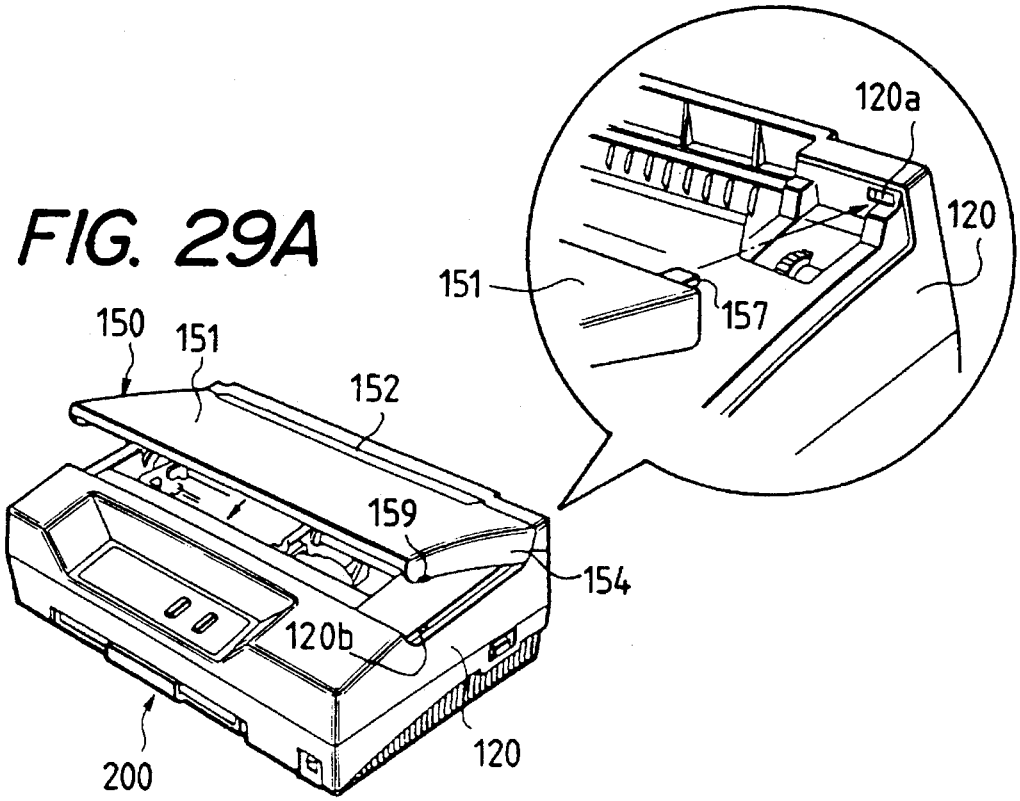

FIG. 30A
FIG. 30B
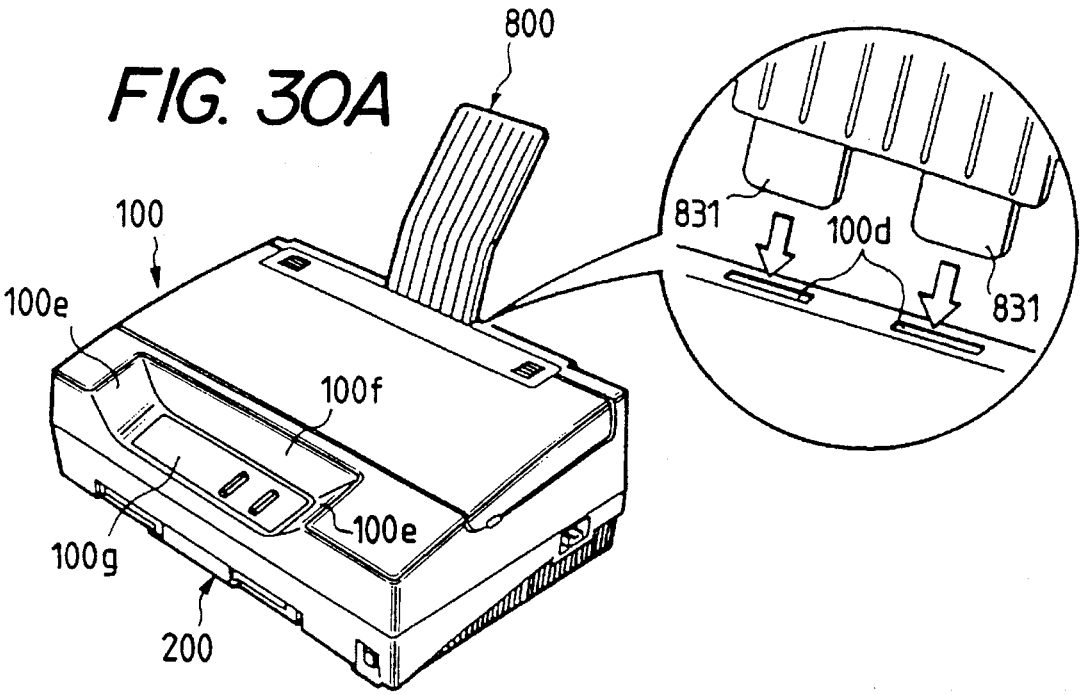
FIG. 33
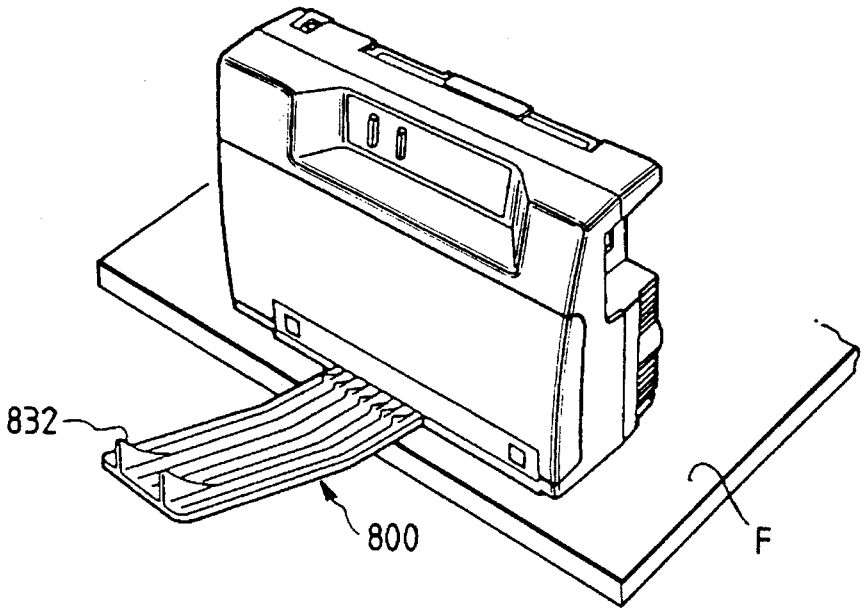

PRINTER HAVING DISCHARGE ROLLERS

This is a divisional of application Ser. No. 07/994,293 filed Dec. 21,1992, now U.S. Pat. No. 5,397,191 (now allowed).

BACKGROUND OF THE INVENTION

1. Field of the Invention

The present invention relates to a printer. More particularly, the invention relates to a printer which is compact, can accurately supply paper and has reduced noise characteristics. Additionally, the printer enables easy recovery from the paper jams and can be selectively operated in various modes according to the user's preference.

2. Background Art

The following is a discussion concerning a conventional paper supply mechanism and considerations in designing such a mechanism. In designing desk-top printers, one of the major objects is to minimize the space occupied by the printer. In particular, in the case of small printers of this type, it is desired to reduce the size of the printer to be approximately the same size as the paper. For this reason, design freedom of the paper transport path is limited to provide such a layout that a recording paper is taken out of the placing position at an acute angle. Accordingly, when the paper has been conveyed toward the platen, conveyance of the paper is impeded by the paper supply rollers, so that the paper supply rollers must be displaced to a dislocated position (i.e., to a "no paper feed" position). To transport the paper to the print stage without any skew in the paper, as described in Japanese Patent Publication No. Sho. 58-6637 or 62-39261, it is necessary to use the device for causing the paper to bend at a position of this side of the platen to thereby correctly positioning the paper with respect to the platen with a self-restoring force of the paper, by rotating the platen reversely while the paper abuts against the platen or by once nipping a leading edge of the paper in the platen and thereafter rotating the platen reversely to return back the leading edge of the paper out of the platen.

Considerably complicated mechanisms are required for dislocating the paper supply rollers and for rotating the platen in the forward and reverse directions. Japanese Patent Laid-Open Publication No. Hei. 3-244569 discloses a technique where an intermittent motion gear is cyclically driven so as to supply the paper. Japanese Patent Publication No. Hei. 1-184174 discloses a technique where a one-way clutch is driven when the carriage is moved to the paper feed position so as to supply the paper. However, each of these techniques does not provide a power transmission means on the carriage.

In the case that these discharged techniques are applied to the small size printers, it is impossible to reduce the size of the printer, and the cost to manufacture the printer is increased. Attempts to minimize the size of the printer without using such a power transmission mechanism have resulted in poor paper supply characteristics (i.e., unsmooth paper supply).

Japanese Laid-Open Patent Publication No. Hei. 2-295837 discloses a paper supply mechanism using a planetary gear mechanism. The paper supply mechanism is not provided with a stopper for suppressing an excessive swing motion of the paper supply rollers. As a result, the paper supply rollers excessively press against the paper, thereby forming wrinkles in the paper.

The following is a discussion of a conventional paper transport mechanism. FIG. 38 is a schematic view showing an example of a printer. In the figure, a paper supply roller 1 functions to individually supply recording papers P from a cassette 2 containing the paper. The supplied paper P is guided by a paper guide 4, and conveyed around a platen 5. The paper P is also transported while being nipped between two hold rollers 6 and the platen 5. After being conveyed past print head 7 for printing thereon, the paper P is discharged through an exit 8. The hold rollers 6 are mounted on a holder **6*a* which is attached through a compressed spring 6*b* to a base frame 9. With the paper transport mechanism thus constructed, the hold rollers 6 and the platen 5** cooperate to nip the paper P therebetween and to convey the paper forward.

One of the possible approaches for reducing the size of the printer thus constructed is to locate the cassette 2 within the main body of the printer. One example of such an approach is illustrated in FIG. 38 wherein the paper supply roller 1' and the cassette 2' are disposed as indicated by phantom lines.

During the paper feeding operation, rotation of the paper supply roller 1 is temporarily stopped after the paper P moves forward a preset distance. In this case, the paper supply roller 1 tends to prevent conveyance of the paper by the interaction of the platen 5 and the hold roller 6. Specifically, when the paper supply roller 1 is located at the position indicated by phantom line 1' resting on the paper P', tension generated in the paper P' acts to urge the paper in the direction of arrow a tending to reduce the pressure applied by the hold roller 6 against the platen 5. As a result, a pressure force (i.e., a paper moving force) fb applied by the roller 6 against the platen 5 is reduced thereby preventing accurate conveyance of the paper.

A further problem associated with the conventional printer is the jamming of the paper. Referring to FIG. 38, a case C of the printer consists of a main body case C1 and a cover case C2. The cover case C2 is rotatable between open and closed positions with respect to the main body case C1. If a paper jam occurs at a position A2 downstream of printing stage A, a user can open the cover case C2 and remove the jammed paper.

Position A1 upstream of the print stage is covered with the main body case C1. Further, the paper guide 4 is fastened to the main body case C1 by means of a screw **4*a*. Accordingly, it is difficult to remove the jammed paper at the position A1. If a user attempts to pull the end of the paper in an effort to remove the jammed paper, the paper will frequently tear resulting in the user being unable to remove the remaining piece of paper disposed at position A3** near the hold rollers. To remove it, a service man must be called.

Designs which allow the user to remove the jammed paper disposed at positions upstream and downstream of the printing position are disclosed in Japanese Utility Model Laid-Open Publication No. Sho. 63-7548 and Japanese Patent Laid-Open Publication Nos. Hei. 2-297469 and 2-69273. In the construction of these printers, the print mechanism or the paper transport mechanism is removed or opened to enable the jammed paper to be removed. However, repeated removal or opening of these mechanisms will adversely effect the mechanisms.

An example of the cassette is shown in FIGS. 39(*a*) and (*b*). A cassette body 11 contains a number of papers P. A pair of peel-off claws 13 individually remove papers from the stack of papers and supply them in a forward direction. A hopper 14 urges the paper P upwardly such that the corner edges **12*a* thereof abut against the peel-off claws 13. The hopper 14 is assembled into the body 11 by inserting the forward portion of the hopper, having a curved end 14***a*, into an opening 11*a* in the body 11 until the curved end 14*a* engages a protruding piece 11*b* of the body 11. As a result, the hopper 14 can pivot within a limited range about the engaging point of the curved end 14*a* with respect to the protruded piece 11*b*. A spring 15, provided between the rear portion of the hopper 14 and the body 11, acts to urge the hopper, and attendantly the stack of paper P, upwardly.

The cassette, containing the paper stack P, is loaded into the printer body. Thereafter, the printer is turned on resulting in the paper supply roller 16 rotating in the direction of an arrow A. Correspondingly, the uppermost sheet of paper is conveyed in the direction of arrow B causing the corner edges 12*a* and 12*a* of the paper to abut against the peel-off pawls 13 and 13 so that the sheet is curved upwardly. At the instant that the progressive curving of the paper reaches a critical point, the corner edges 12*a* and 12*a* are released from the peel-off pawls 13 and 13, so that the uppermost paper is separated from the underlying paper, and is moved forwardly. In the cassette thus constructed, the peel-off pawls 13, provided separately from the cassette body 11, are secured to the body 11 in such a manner that after the hopper 14 is mounted in the manner discussed above, a pin 13*b* protruded from the underside of a mounting piece 13*a* is inserted through an elongated hole 11*c* of the body 11 and is properly positioned. Thereafter, the mounting piece is fastened to the body 11 by means of a fastening piece 13*c*.

Due to such a construction where the peel-off pawls 13 are independent of the cassette body 11, it is difficult to improve the positioning accuracy of the cassette with respect to the paper supply roller 16 to achieve the best paper separation performance.

Further, in the case where the peel-off pawls 13 and the cassette body 11 are formed as a unitary construction, it is impossible to secure the hopper 14 to the cassette. That is, in the process of engaging the protruded piece 11*b* of the cassette body 11 with the curved end 14*a* of the hopper 14 through the opening 11*a*, the lower side of the corners 14*b* of the hopper 14 would abut against the upper sides 13*d* of the peel-off pawls 13 and 13.

The following is a discussion of the paper discharge mechanism and tractor in reference to a second example of a printer, as illustrated in FIG. 40.

As shown, a discharge roller 28, disposed downstream of platen 20, is forcibly fitted around a roller shaft 22, which is supported by a frame member 21. The discharge roller 28 receives a drive force transmitted through a gear (not shown) fixed to the end of the roller shaft 22.

After printing, a cut paper P1 is lifted due to a friction force by the discharge roller 28 past the discharge cover 24. A discharge spring 23 formed with a thin resin is provided in order to force the cut paper P1 into the printed paper container.

A tractor 27 is disposed upstream of the printing stage for conveying continuous paper P2. Tension must be constantly applied to the continuous paper P2 in order to secure the proper pitch of the continuous paper P2. To this end, the peripheral speed of the discharge roller 28 is set to be higher than that of the platen 20.

FIG. 41 is a sectional view of a tractor release mechanism in a friction condition where the cut paper P1 is pressed against the platen 20, and is conveyed forwardly in cooperation with paper hold rollers 26*a* and 26*b*. The hold rollers 26*a* and 26*b* are pivotally supported by a holder 36. A paper hold lever 37 is attached to a release shaft 38 supported by a frame 31 of the printer body. A coiled spring 39 is placed on the frame 31. The coiled spring 39 urges the roller holder 36 upwardly through the paper hold lever 37. As a result, the hold rollers 26*a* and 26*b* contact the platen 20, thereby generating a pressure force against the platen.

FIG. 42 is a sectional view of a tractor release mechanism in a state where the cut paper P1 is detached from the platen 20, and a continuous paper P2 is supplied from the tractor 27 into the printer body.

When a release lever (not shown), attached to the release shaft 38, is turned to a release position, the release shaft 38 and the paper hold lever 37 both pivot in the direction of arrow A, while resisting the urging force of the coiled spring 39. The roller holder 36 moves downwardly and the hold rollers 26*a* and 26*b* separate from the platen 20. A release state is set up in the mechanism. Thus, the paper hold lever 37, the release shaft 38, and the release lever (not shown), which make up the tractor release mechanism, are mounted on the frame 31 of the printer body.

As described above, in the second example of the conventional printer, the frame member 21, the roller shaft 22, a chain of gears (not shown), and the discharge spring 23 are required for the paper discharge mechanism. Therefore, there are an excessive number of parts requiring a correspondingly long assembly time and resulting in an increased cost. When the leading edge of the paper abuts against the discharge spring 23, the spring acts as a load. As a result, the pitch of the paper is not uniform. Further, relatively loose contact of the paper occurs, generating a noisy printing sound.

When only the printer body, absent the tractor 27, is operated to print visual information on a cut paper P1, the paper hold lever 37, the release shaft 38 and the release lever, which form the tractor release mechanism, are not used. Further, the number of parts of the printer body is increased resulting in an increase in the cost of manufacturing and the size of the printer.

Japanese Patent Laid-Open Publication No. Hei. 3-200660 discloses a printer using a planetary gear for the drive force transmission mechanism of the discharge roller. In this printer, since the planetary gear, which does not directly contact the platen, is used for the intermediate transmission mechanism, the mechanism is complicated.

Recently, to reduce the space occupied by the printer, the printer is placed in various different positions. For example, the printer of FIG. 40 is generally positioned in an upright manner with the rear side 41 of the printer acting as the bottom surface.

Reduction of noise generated by the printing head 42, particularly the wire dot head, has also been desired in this technical field. Most of the sound generated by the printing head 42 during operation is discharged through a discharge port 49 and a discharge path 48. To reduce the noise, it is desirable to form the discharge port in the rear side 41 of the printer. However, positioning the printer in this manner creates problems in that access to the printed paper is poor. Thus, use of the printer in the upright position is not practical.

The following is a discussion of the tray for receiving discharged papers. In the printer shown in FIG. 40, a paper P1 is stored on the tray 51 with the printed side facing upwardly. In such printers, a user can read the printed material when the paper is being discharged. However, the user must rearrange the papers in a reverse order when the user removes the set of printed papers from the tray. In some known printers, the printed paper is stored with the printed side facing downwardly. In the printer which stores the paper in a downwardly facing manner, there is no need of reversely ordering the set of papers.

To overcome these problems, printers which allow the printed papers to be selectively stored facing upwardly or downwardly have been proposed in Japanese Patent Laid-Open Publication No. Hei. 3-200660, Japanese Patent Laid-Open Publications Nos. Sho. 64-81758, Sho. 63-101256 and Japanese Utility Model Laid-Open Publication No. Hei. 2-103053.

Each of these printers employs a turning mechanism to turn the discharge tray for selecting the upward-facing or downward-facing state of printed papers. However, the turning mechanism requires complicated structure and leads to increase in the size of the printer.

The following is a discussion concerning the paper feed path of conventional printers. There is a known printer which makes the environmental setting by communication with the user in the following manner. In this type of printer, the printer prints a message to the user on a paper, and transports the paper with the printed message up to a position where the user can read it. Then, the printer retracts the printed paper, and prints another message on the paper, and transports again the printed paper to that position. In this way, the use environment of the printer is set.

In this type of the printer, the printed paper must be transported until it is discharged from the discharge port to a position where the user can read the printed message, and then the printed paper must be retracted. Therefore, the return path of the printed paper is relatively long resulting in an increase size of the printer.

A principle object of the invention is to provide an printer which is compact, can accurately supply paper and has reduced noise-characteristics. Additionally, an object of the invention is to provide a printer which enables easy revery from paper jams and can be selectively operated in various modes according to the user's preference.

SUMMARY OF THE INVENTION

A printer of the invention comprises a paper feed roller which is rotatable between a paper feed position and a non-feeding position, drive force transmitting means for transmitting a drive force to the paper feed roller, a carriage reciprocatively moving along the width of the paper fed by the paper feed roller, and intermediate transmission means attached to the side of the carriage. Only when the carriage is in a stand-by position, the intermediate transmission means couples with the drive force transmitting means to transmit to the paper feed roller a paper-feed directional rotating force and pivots the paper feed roller to the paper feed position. The intermediate transmission means is preferably an idler rotatably mounted on the side of the carriage. The paper feed roller is preferably driven through a planetary gear mechanism including a sun gear provided around a drive shaft, a paper-feed roller holder rotatably mounted around the drive shaft, and a planetary gear coaxially provided with the paper feed roller supported with the paper-feed roller holder. A stopper is provided for preventing the paper-feed roller from excessively pivoting to the paper feed position. The stopper is formed integrally with the paper-feed roller holder and designed to contact with the frame of the printer.

The printer of the invention further comprises a paper feed roller for feeding a paper, a paper holder roller for transporting a paper fed with the paper feed roller in a state that the paper is nipped between it and a platen, and a lever for supporting the paper holder roller at one end thereof so as to constantly urge the paper hold roller toward the platen, and supporting at the other end thereof a tension roller, which is located between the paper holder roller and the paper feed roller and receives a tension of the paper.

A cassette body for containing a plurality of papers fed by a paper feed roller includes separation pawls, formed integral with the cassette body, for individually separating papers from a bundle of papers for paper feeding. It is preferable that the separating pawls are each tilted downwardly in the direction of the paper feed so that the paper is easily warped or curved when it is separated from the bundle of papers. A hopper is provided for urging the paper upwardly so that the corners of the paper abut against the separation pawls. The corners of the hopper facing the separation pawls are preferably bent in the same direction as that of the separation pawls so that the paper is easily warped when it is separated from the bundle of papers. Further, the hopper is preferably constructed such that it is movable forwardly and backwardly in the direction toward the separation pawls. Further, the cassette body preferably includes a stopper for stopping the regressive motions of the hopper after the hopper is moved forwardly. A flap for restricting warpage or curvature of the paper when the paper is separated from the bundle of papers in the cassette is preferably formed integral with the cassette body. The flap is preferably located on the upstream of the paper feeding direction by the paper feed roller.

The printer of the invention further comprises a roll-shaped platen, a discharge roller for discharging the paper that is fed with the platen, and a transfer roller located between the platen and the discharge roller. The transfer roller directly contacts the platen to move with respect to the platen in a planetary motion, only when the platen rotates in the paper feed direction. On the other hand, the transfer roller contacts the discharge roller to transfer a rotating force of the platen to the discharge roller. It is preferable that the discharge roller be rotatably supported with a discharge holder, the transfer roller be rotatably supported with an elongated hole bent along the circumferential surface of the platen, the discharge holder be supported in a rotatable manner by the printer case, and the transfer loller be urged, by urging means, in the direction to bring the transfer roller into contact with the platen. The urging means is preferably a tongue-like piece integral with the upper case or a spring means fastened at one end to the case.

The printer of the invention further comprises a paper supply path for supplying papers to a print stage, a reverse paper-transport path, provided separately from the paper supply path, for transporting a paper in the reverse direction, and a discharge port for guiding the paper reversely transported through the reverse paper-transport path into a space between a printer placement surface and the bottom surface of the printer. It is preferable that the printer be placed upright in a state that the bottom surface is set upright on the printer placement surface, and a manual inserter guide forming a part of a paper discharge port is provided, in a rotatable manner, at the discharge port of the reverse paper-transport path.

According to another aspect of the invention, the printer comprises a first bottom surface that may face the printer placement surface, and a second bottom surface, substantially orthogonal to the first bottom surface, which may face the printer placement surface. The second bottom surface is preferably the rear side of the printer when the first bottom surface faces the printer placement surface. A paper discharge port for discharging printed papers toward the top surface of the printer is preferably provided in a location where the printer top surface side of the rear side intersects the printer top surface.

According to yet another aspect of the invention, the printer comprises a single paper discharge port for discharging printed papers, insertion holes provided at the side of the discharge port, and a discharged paper tray which is selectively tiltable with respect to the vertical direction by changing the direction of the tray when it is inserted into the insertion holes.

When the tray is attached to the printer body in a state that it is tilted toward the printer top surface, the tray preferably serves as a guide plate for guiding the printed paper onto the printer top surface for its placement thereon. In this case, it is preferable that the printer top surface be tilted so that the paper guided by the discharge tray slides down thereon, and includes a concavity for guiding the paper toward the central part of the width of the printer. The cassette is preferably provided with a stopper for stopping the paper on the printer top surface.

According to still another aspect of the invention, the printer comprises a print stage having a platen, and a head, disposed in opposition to the platen, for printing visual information on a paper transported between the head and the platen, a paper supply path for supplying a paper to the print stage, and a discharge path for outwardly discharging the paper printed at the print stage. The printer further comprises a first cover forming one side of the paper supply path and being either rotatable between an open and closed position or detachable from printer body and not accompanied by any part in the print stage, and a second cover forming one side of the paper discharge path, the second cover also being either rotatable between an open and closed position or detachable from printer body and not accompanied by any part in the print stage.

It is preferable that the first cover be attachable to and detachable from the printer body so that a tractor unit can be attached to the printer body in place of the first cover. When the tractor unit is attached to the printer body, a guide portion forming one side of the paper supply path is preferably constructed with the tractor unit in place of the cover.

According to still another embodiment of the invention, the printer comprises a platen, a carriage carrying a head, disposed in opposition to the platen, for printing visual information on a paper supplied to between the head and the platen, the carriage reciprocatively moving parallel to the platen, a gap changing mechanism for changing a gap between the platen and the head, and gap select means for selecting a gap between the platen and the head by operating the gap changing mechanism. The printer further includes a single detector for detecting the gap, which has been selected by the gap select means, and arrival of the carriage at one end of the reciprocatively moving range.

The printer further comprises a printer body including a paper hold roller for feeding a cut paper while pressing the paper against a platen, a tractor unit, optionally attached to the printer body, for transporting a continuous paper, a release mechanism, installed in the tractor unit, for detaching the paper hold roller from the platen, and a detector, provided in the printer body, for detecting whether the paper hold roller is pressing against platen or not, operated by the release mechanism.

BRIEF DESCRIPTION OF THE DRAWINGS

Other objects, features, and advantages of the present invention will be apparent by reading the detailed description in connection with the accompanying drawings, in which:

FIGS. 25A, 25B and 25C are views for explaining how the first cover is assembled into the printer body;

FIG. 27 is a perspective view showing how a paper is manually inserted into the printer when the printer is placed upright;

FIG. 28 is a perspective view showing the printer when a second cover and a paper discharge tray are removed;

FIGS. 29A and 29B are views for explaining how the second cover is assembled into the printer body;

FIGS. 30A and 30B are views for explaining how the discharge tray is attached to the printer body;

FIG. 33 is a perspective view showing how the discharge tray is attached to the printer body when the printer placed upright;

DETAILED DESCRIPTION OF THE PREFERRED EMBODIMENT

A printer according to the preferred embodiment of the present invention will be described with reference to the accompanying drawings.

The general description of the printer will be first given. In the printer, resin material is used for the respective units so long as use of resin material is allowed, and these units are snap coupled to a case body to enable easy assembly and disassembly of the units when the printer is scrapped. Accordingly, many component materials of the printer can be recycled by disassembling the printer.

Figure 1:
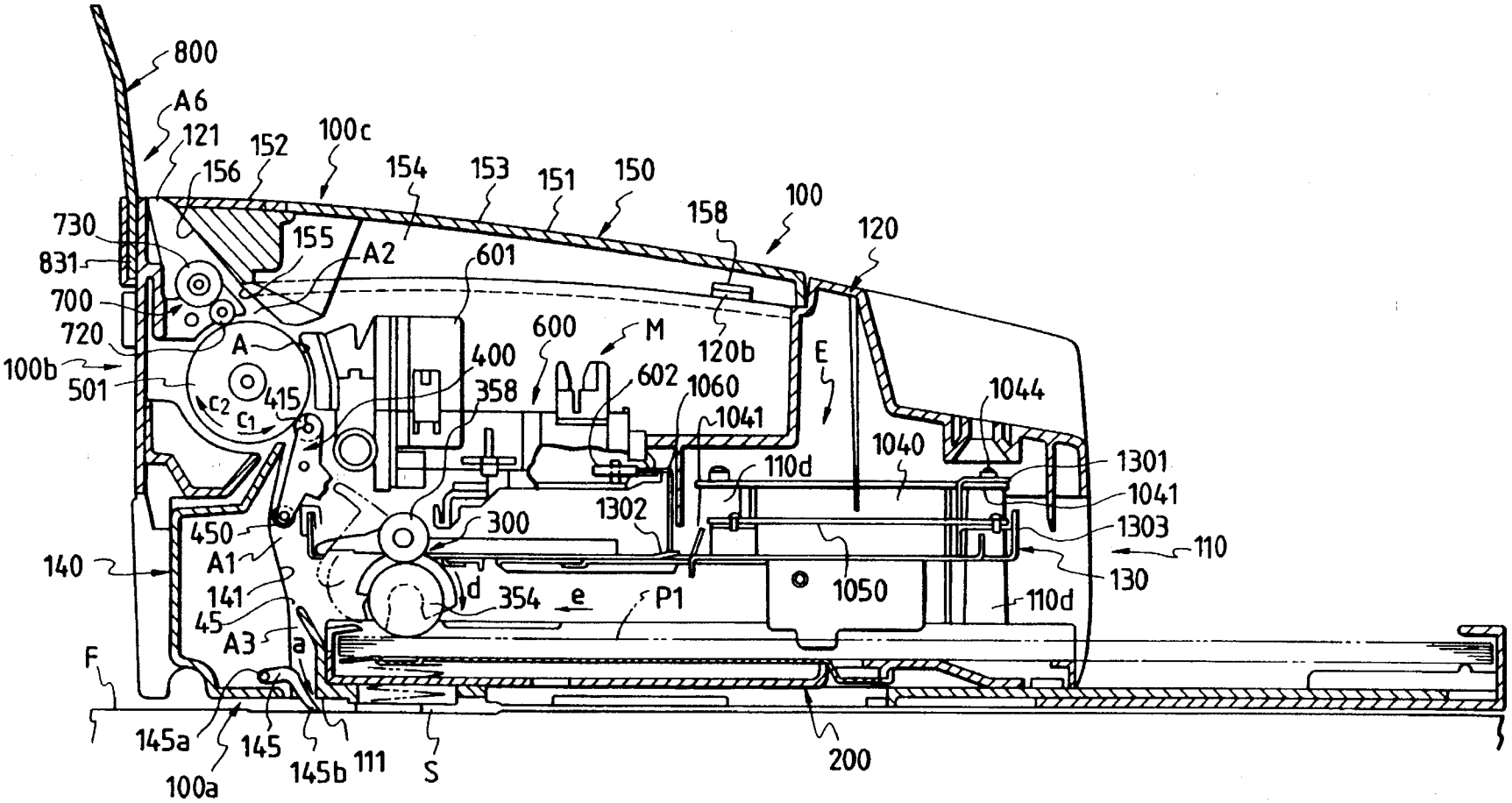
FIG. 1 is a sectional view showing an embodiment of a printer according to the present invention.
Figure 2:
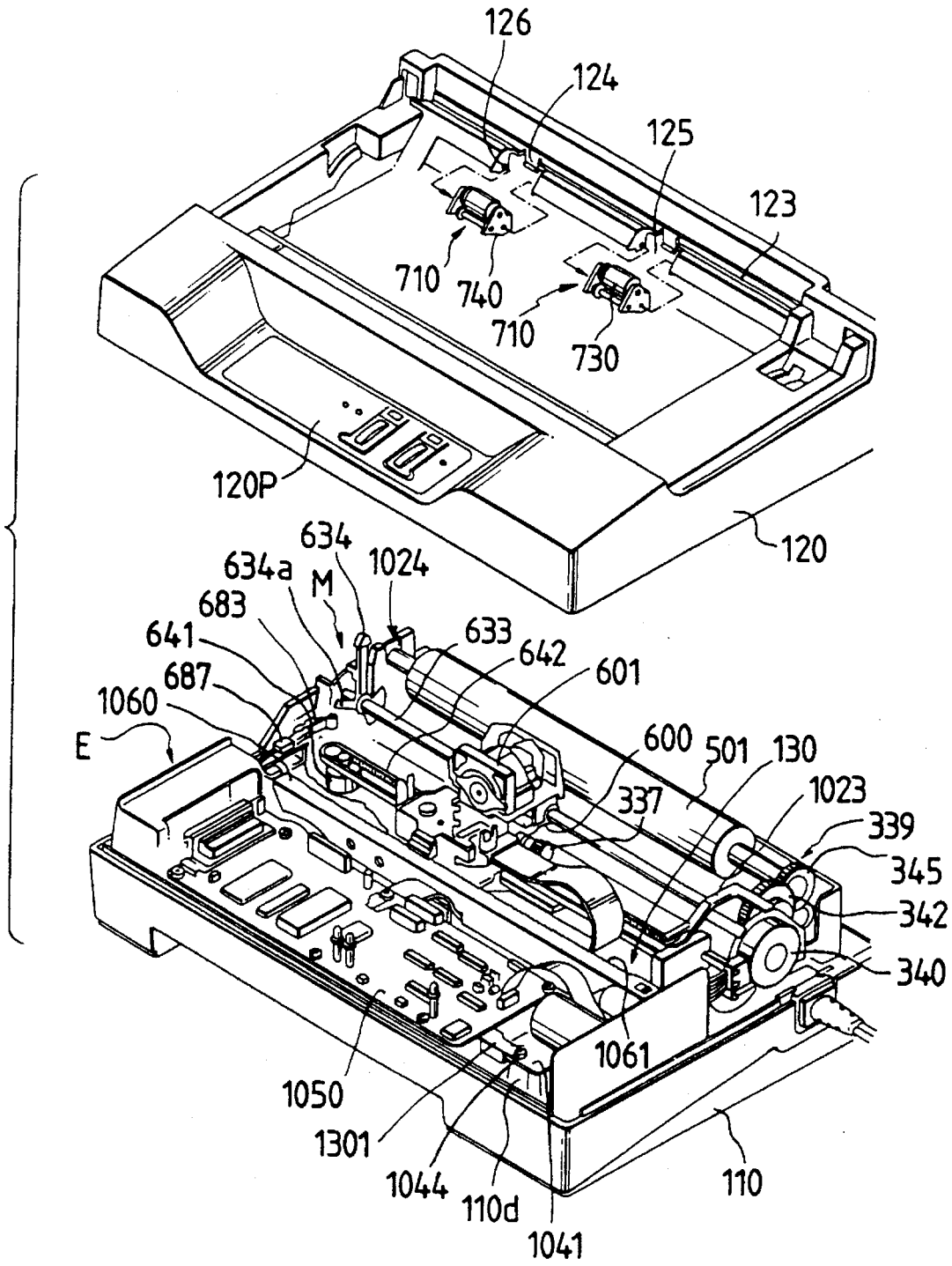
FIG. 2 is a perspective view showing the printer with the upper case separated from the body.

In FIGS. 1 and 2, a printer body 100, having a cuboid shape, includes a lower case 110 and an upper case 120 coupled to one another. A cassette 200 for supply papers is loaded into the bottom part of the lower case 110.

A paper supply mechanism 300 individually receives the cut papers and supplies them in a forward direction. The supplied paper passes a paper supply path A1 and a paper transport mechanism 400, and reaches a print stage A located between a platen 501 and a print head 601 mounted on a carriage 600.

Figure 6:
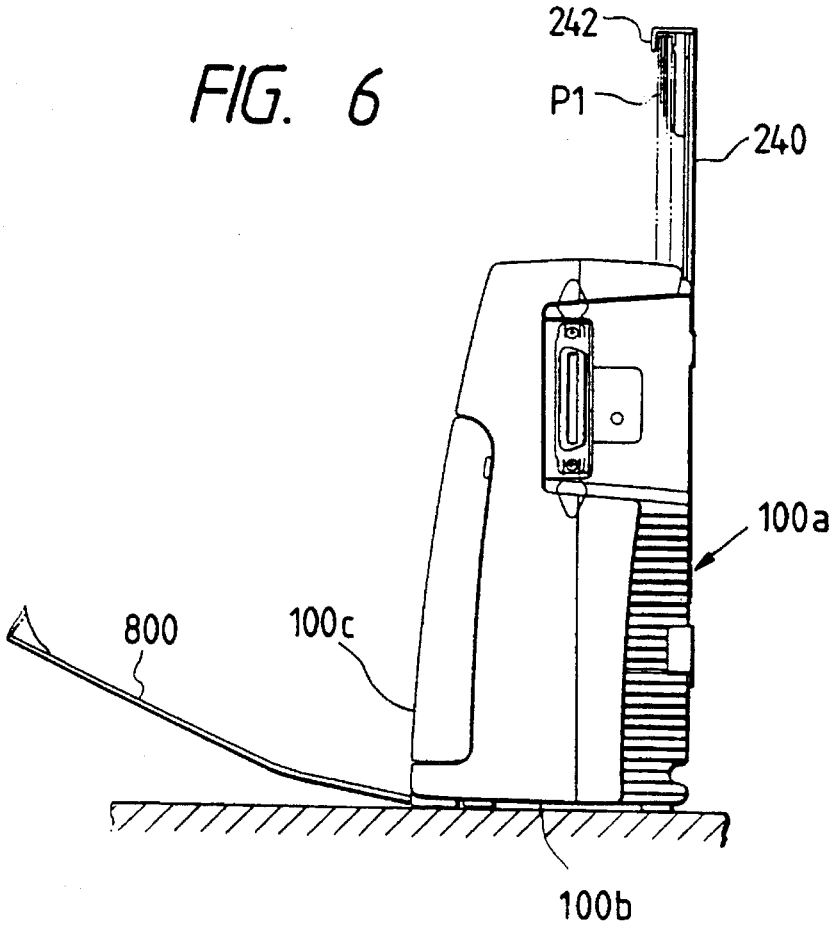
FIG. 6 is a left side view of the printer in the upright position.

After printing occurs at the print stage A, the paper is conveyed past a paper discharge path A2 and a discharge mechanism 700, and discharged into a discharge tray 800 from a discharge port 121. The printer may be used in a horizontal state as shown in FIG. 1 or in an upright state as shown in FIG. 6.

A tractor unit, optionally provided, is used for printing visual information on a continuous paper, as will be described later.

The printer thus constructed will be described in detail. The printer body 100 will be first described. In FIGS. 1 and 2, a base frame 130 is formed of a metal plate connecting to a ground line. A transformer 1040 is mounted in such a way that flanges 1041 thereof are fastened to poles 110*d* integral with the bottom of the lower case 110 by means of screws 1044. One of the flanges 1041 is also fastened to a support member 1301 constituting an upwardly bent part of the base frame 130. The support member 1301 serves as a radiator plate for the transformer 1040 and also as the ground.

Reference numeral 1050 designates a control board mounted on the base frame 130. CPUs, ICs and other electronic parts for controlling the operation of a print head 601, and the like are mounted on the control board.

A shield plate 1303 constitutes an upwardly bent, forward portion of the control board 1050 on the base frame 130. The shield plate 1303 prevents noise emanating from a space between the base frame 130 and the control board 1050 from being emitted to the exterior.

A partitioning plate 1060 partitions an electrical system E including the control board 1050 and the like from a mechanism M including the print head 601 and the like. The partitioning plate 1060 also serves as a shield plate for confining the noise emanating from a space between the base frame 130 and the control board 1050. In order to ensure that the shield plate functions properly, the base frame 130 is formed with a reed 1302, which is upwardly bent so as to contact with the bottom edge of the partitioning plate 1060. The partitioning plate 1060 also serves as a rack 1061 in mesh with an ink ribbon wind-up gear 602 mounted on the carriage 600.

In FIG. 2, side frames 1023 and 1024 support the mechanism M including the platen 501 and the like. The platen 501 is rotatably driven through a chain of gears by a paper supply motor 340, such as a stepping motor, for example, provided in a drive unit 339 which is assembled into the side frame 1023.

The print head 601 is mounted on the carriage 600. The carriage 600 is movable in parallel with the platen 501, along a carriage guide shaft 633 by the combination of a carriage motor 641 and a timing belt 642. When the print head 601 prints one line, the platen 501 is turned by the motor 340, so that the paper is moved a distance of one line.

The printer, as shown in FIG. 1, includes a first bottom surface 100*a*, which will oppose the printer placement surface F of a desk, for example, and a second bottom surface 100*b*, orthogonal to the first bottom surface 100*a*, which may alternatively be positioned in such a manner as to oppose the printer placement surface F. The second bottom 100*b* is constituted by the rear side of the printer when the first bottom surface 100*a* faces the printer placement surface F.

Even when the printer is placed upright with the rear side 100*b* acting as the bottom, as shown in FIG. 6, a reliable discharge of the papers is ensured since the discharge port 121 is formed in the upper surface 100*c* of the printer at the location where the second bottom surface 100*b* intersects the upper surface 100*c*.

With the structure arranged such that the discharge port 121 is formed in the upper surface 100*c* of the printer at the location where the second bottom surface 100*b* intersects the upper surface 100*c*, most of a sound generated when the printer operates travels toward the rear side of the printer as seen from FIG. 1. This leads to noise reduction.

Figure 7:
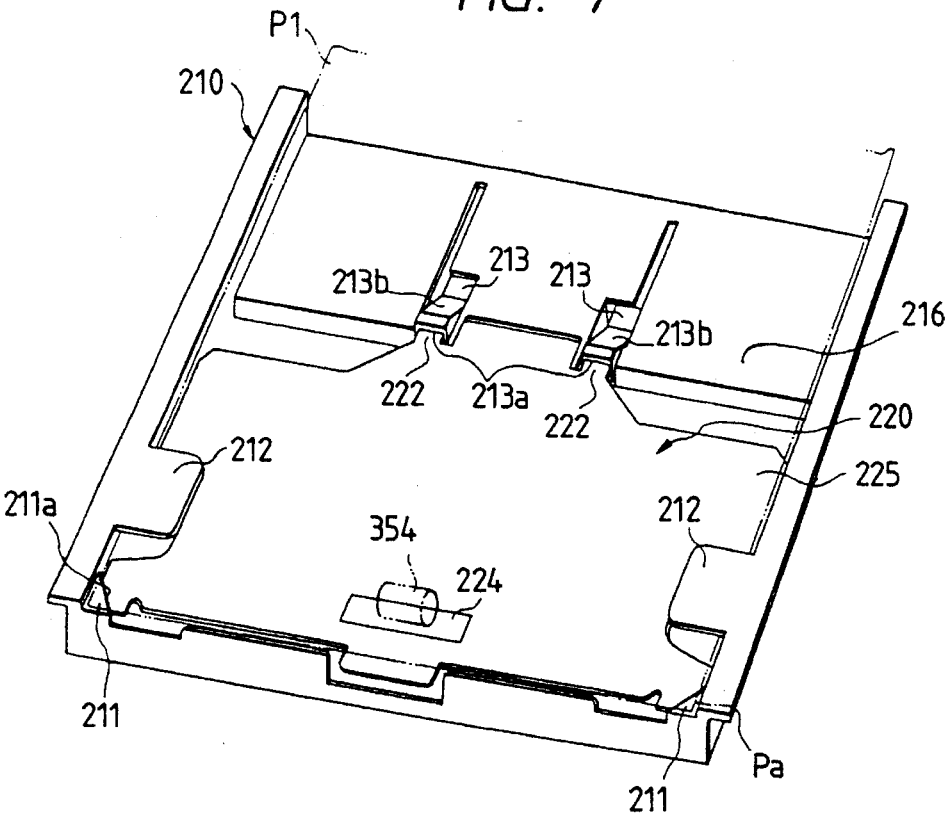
FIG. 7 is a perspective view showing a paper supply cassette.
Figure 8:
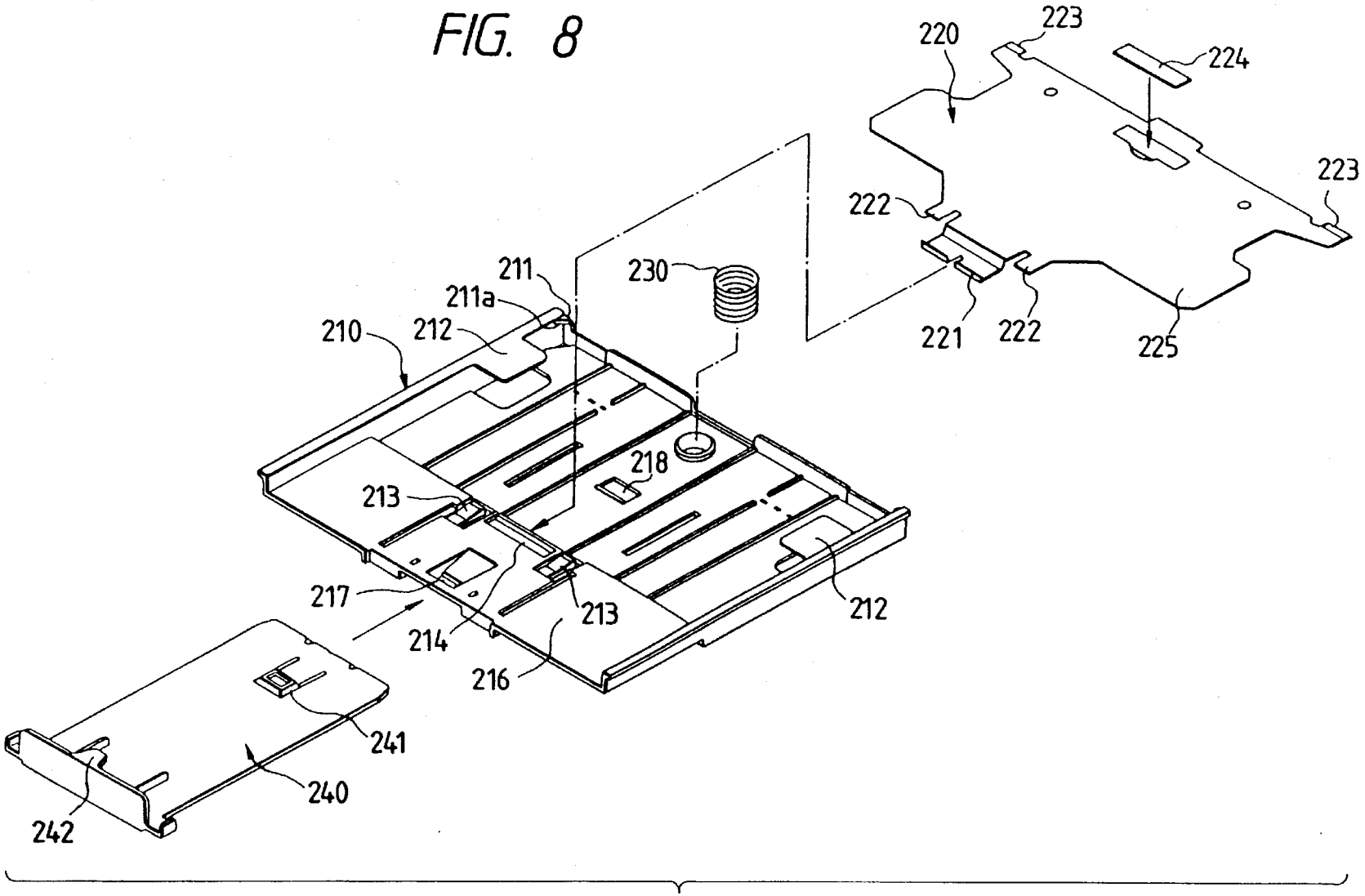
FIG. 8 is an exploded perspective view of the cassette.

The respective portions in the printer body will be described in details. The cassette 200 will first be described. FIG. 7 is a perspective view showing the cassette for supplying papers; FIG. 8 is an exploded perspective view of the cassette; and FIG. 9 is a cross sectional view, partly omitted, of the cassette.

As seen from these figures, the cassette 200 for storing a plurality of papers P1, includes a cassette body 210 and a hopper 220. Separation pawls 211 are integrally formed at the corners of the forward portion of the cassette body 210. The separation pawl 211 extends in the rearward direction and is tilted slightly upwardly when viewed in cross section, as can be seen in FIG. 9. With the shape of the pawls, the paper corners may be smoothly bent and released. An edge 211*a* of the pawl, which will be in contact with the paper when the corner part Pa of the paper is released, is relatively sharp, providing a smooth paper separation.

Paper holders or flaps 212, integral with the cassette body, function to restrict the paper from warping more than a desired amount. These flaps are located rearwardly of a paper-feed roller 354 as viewed in the paper feed direction. Stoppers 213, integral with the cassette body, are raised from the bottom surface 216 of the cassette body. The front face 213*a* of the stopper 213 comes in contact with the leading edge of engaging pieces 222 of the hopper 220, thereby stopping the rearward movement of the hopper 220.

Figure 9:
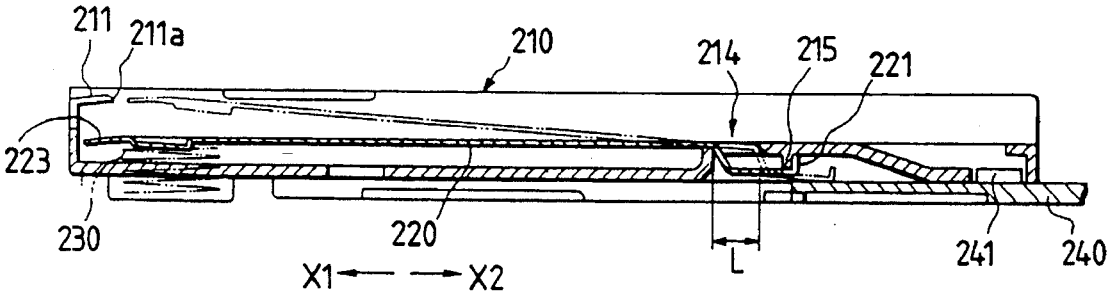
FIG. 9 is a cross sectional view, partly omitted, of the cassette.

The hopper 220, as shown in FIG. 9, is inserted through an opening 214 of the cassette body 210 until it engages the protruded piece 215 of the cassette body. The hopper thus inserted may be pivoted about the hooked part with respect to the cassette body 210. A spring 230, provided between the hopper 220 and the cassette body 210, urges the hopper 220 upwardly so that the hopper forces the paper P1 upwardly so that the corners Pa of the paper move toward the separation pawls 211. The opening 214 is designed so that its width L is larger than that of the conventional printer, discussed above. Within the range of the width L, the hopper 220 is movable back and forth (in the direction toward the separation pawl 211). With the large width L of the opening, the hopper 220 may be attached to the cassette body 210 in a state that it is moved rearwardly with respect to the separation pawl 211 in the direction of arrow X2, as indicated by a phantom line in FIG. 9. Accordingly, the hopper can be attached without it interfering with the separation pawl 211. Thereafter, the hopper 220 is moved forward toward the separation pawl as indicated by the solid line in FIG. 9. At this time, the stoppers 213 have been pushed down by the engaging pieces 222 of the hopper 220. When the hopper 220 moves forward and the corners 223 thereof (see FIG. 8) are located below the separation pawls 211, the stoppers 213, which have been pushed down by the engaging pieces 222, are released from the engaging pieces 222. In turn, the stoppers 213 resiliently spring upwardly, so that the front faces 213*a* come in contact with the fore ends of the engaging pieces 222 of the hopper 220. After the hopper 220 is moved forwardly, its backward movement is prevented by the stoppers 213. Accordingly, the paper P1 is reliably urged upwardly so that the corners Pa of the paper move toward the separation pawls 211. The corners 223 of the hopper are bent in the same direction as that of the separation pawls 211 so that the paper tends to warp when a paper is separated from a stack of papers. Reference numeral 224 designates an anti-skid cork, and 240, a paper support withdrawably attached to the cassette body 210. A resilient projection 241 may be pushed down. When the paper support 240 is pulled out and the resilient projection 241 is fitted into a square hole 217, it is fixed in a useable condition. On the other hand, when the paper support 240 is inserted into the cassette body and the resilient projection 241 is fitted into another square hole 218, it is fixed in a housed state. A paper holder 242 retains the stack of papers P1 so as to prevent the papers from falling when the printer is used in the upright state as shown in FIG. 6.

The cassette 200 containing the papers P1, as shown in FIG. 1, is loaded into the lower case 110. When the printer starts up and the paper-feed roller 354 rotates in the direction of an arrow d, the uppermost paper moves in the direction of an arrow e. At the initial stage of the paper movement, the corners Pa of the paper are blocked by the separation pawl 211, so that the corner portions of the paper near the corners Pa is upwardly deflected. The upward deflection of the paper is restricted by the flaps 212 and 212. When the deflecting action reaches a critical point, the corners Pa and Pa are released from the separation pawl 211. The uppermost paper is thereby separated from the paper lying under the former, and is fed to the paper supply path A1.

Figure 39A:
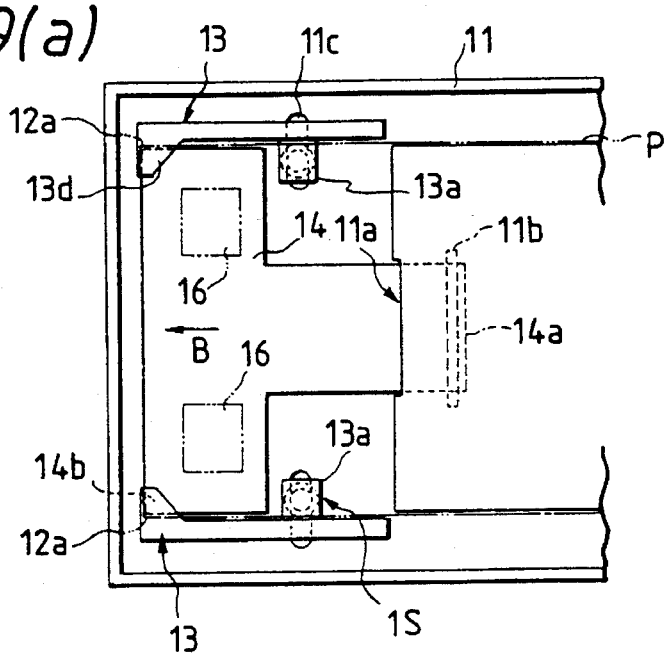
FIGS. 39(*a*) and 39(*b*) are a plan view and a cross sectional view showing a conventional paper supply cassette.
Figure 39B:
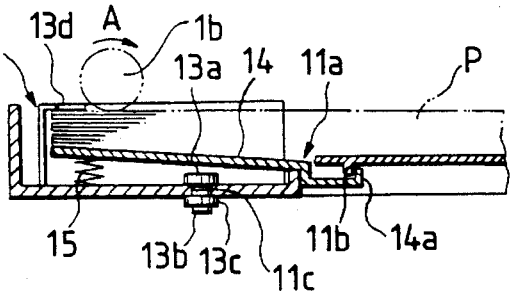
Figure 40:
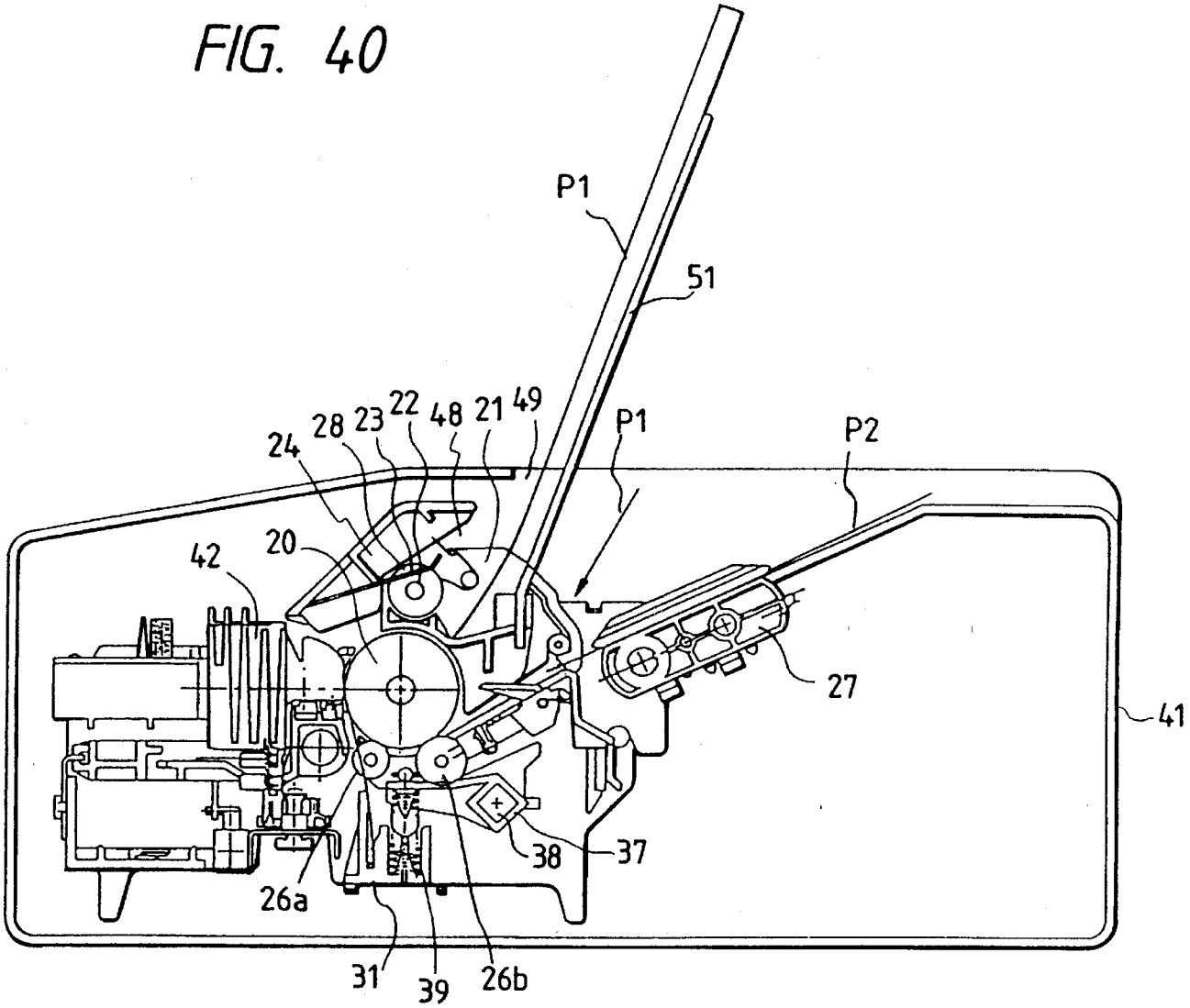
FIG. 40 is a side view showing another example of the conventional printer.
Figure 41:
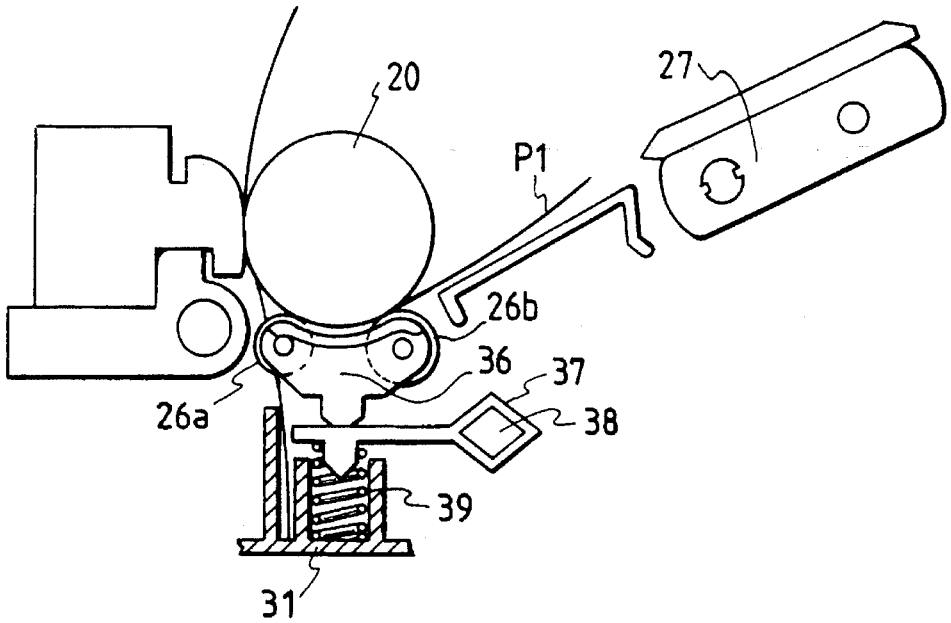
FIG. 41 is a side view showing a tractor release mechanism of the printer.
Figure 42:
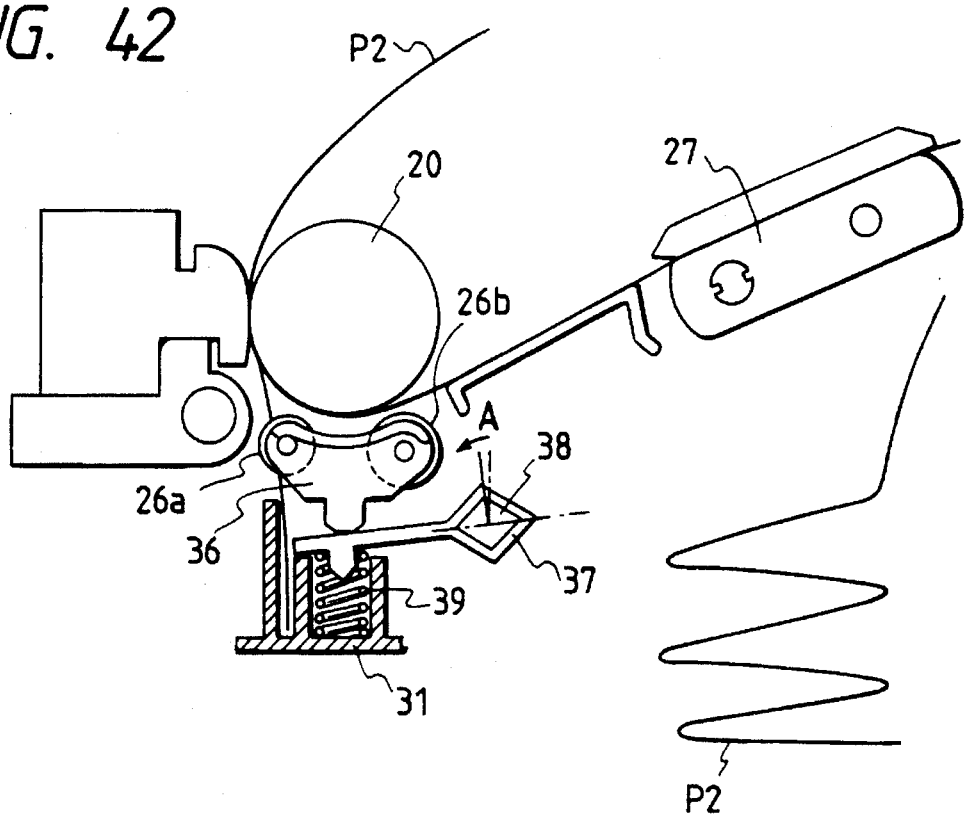
FIG. 42 is a side view showing a tractor release mechanism of the printer.

Since-the separation pawls 211 are integral with the cassette body 210, they are automatically positioned with respect to the paper P1 and the paper-feed roller 354. Accordingly, the positional accuracy is improved to ensure a reliable separation of paper. As noted above, the separation pawls 211 are integral with the cassette body 210. Therefore, there is no need for the space 1S which is required for the mounting of the separation pawls 13 in the conventional cassette (see FIG. 39). Accordingly, in the cassette of the invention, the hopper 220 is extended by the space corresponding to the pawl mounting space, thereby enhancing the paper push-up action. The expanded portions are indicated by reference numeral 225 in FIGS. 7 and 8.

Additionally, it is noted that the separation pawls 211 and the corners 223 have upwardly angle portions which provide smooth and reliable deflection of the uppermost paper to facilitate separation from the remaining papers.

Figure 10:
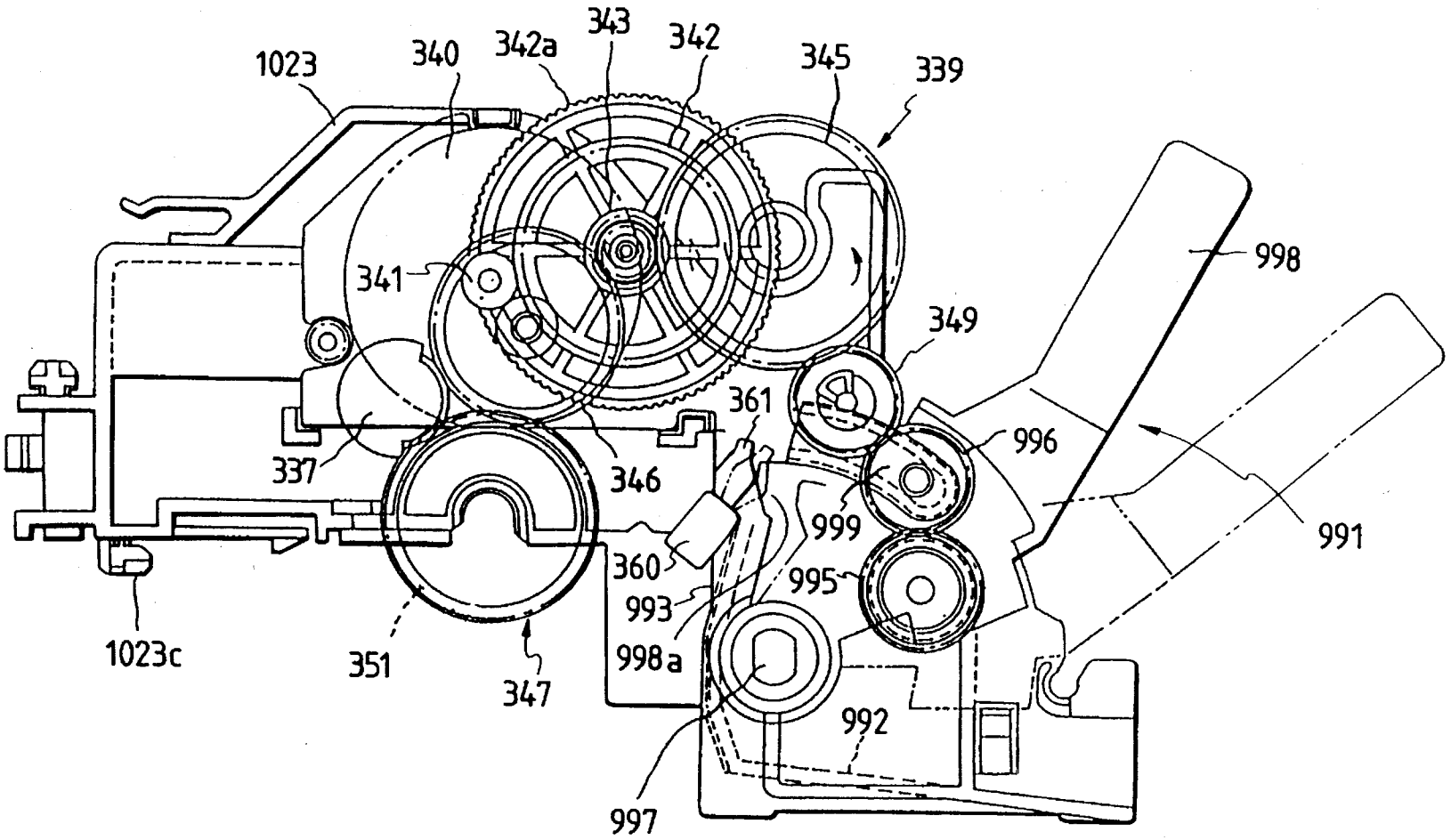
FIG. 10 is a side view showing the drive unit and when viewed from the right side thereof.
Figure 11:
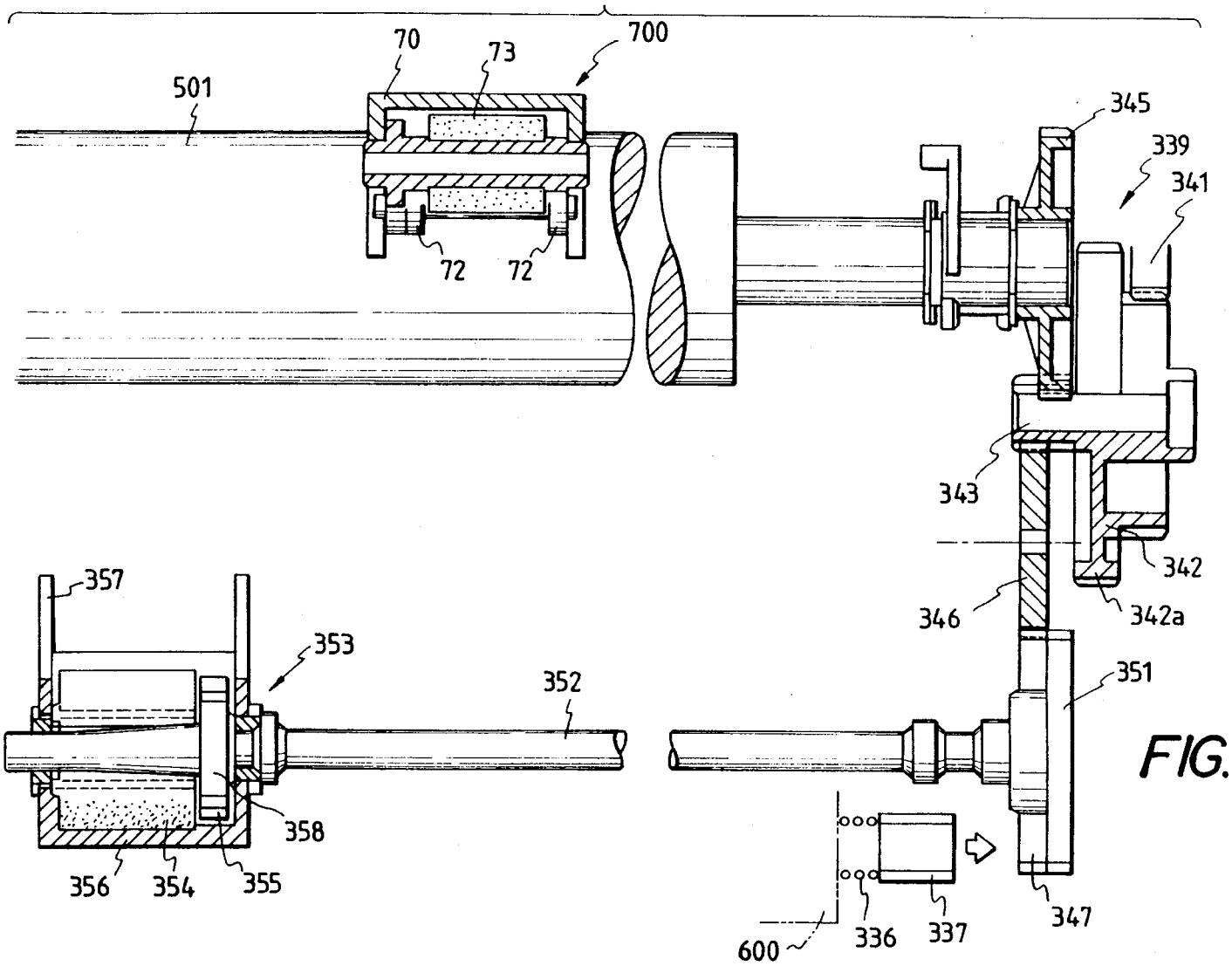
FIG. 11 is a partly in cross section, of a paper supply mechanism and a paper discharge mechanism.

The paper supply mechanism 300 and its related portions will be described. FIG. 10 is a side view showing the drive unit when viewed from the right side thereof. The drive unit 339 is assembled into the right-side frame 1023, as shown also in FIG. 2. The drive unit 339, as illustrated in FIGS. 10 and 11, is formed of a reduction gear 342 engaging with a pinion 341 of the motor 340, a platen gear 345 in mesh with a pinion 343 integral with the reduction gear 342, a paper-supply intermediate gear 346 in mesh with the pinion 343, a paper-supply roller transmission gear 347 interlocking with the paper-supply intermediate gear 346, and a tractor transmission gear 349 in mesh with the platen gear 345. The platen gear 345 drives the platen 501 integral thereto and also drives a tractor of a tractor unit installed in the printer, which will be described later, through the tractor transmission gear 349. As illustrated in FIG. 11, the paper-supply roller transmission gear 347 is rotatably fitted around a paper-feed roller drive shaft 352. A paper-supply roller drive gear 351 is formed at the end of the paper-supply roller drive shaft in a unitary construction.

An idler 337, as shown also in FIG. 2, is provided on one side of the carriage 600. When the carriage 600 is moved to the leftmost side (stand-by position) in FIG. 2, the idler 337 interlocks with the roller transmission gear 347 and the drive gear 351. Drive power is transmitted from the roller transmission gear 347 to the drive gear 351, through the idler 337. In the figure, a spring 336 resiliently urges the idler in the axial direction. Knurls 342*a* are formed on the circumferential surface of the reduction gear 342 to enable manual operation of the printer from the exterior thereof.

Figure 12:
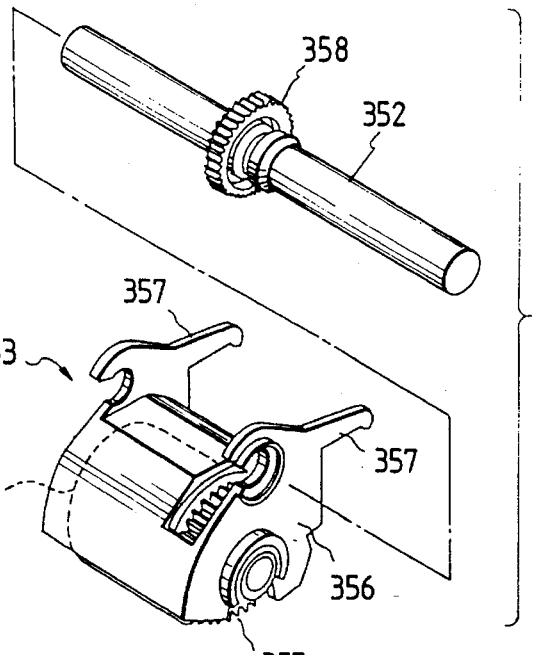
FIG. 12 is an exploded perspective view of an important portion of the paper supply mechanism.

In FIGS. 11 and 12, there is illustrated a paper-supply roller 353 driven by the paper-supply roller drive gear 351. The paper-supply roller 353 functions to selectively set a paper-feed roller holder 356, which axially supports the paper-feed roller 354, to a paper feed position or a non-feeding position, thereby providing a paper supply or reduction of a load after the paper supply.

The upper end of the paper-feed roller holder 356 is rotatably attached to the end of the drive shaft 352, which extends from the drive gear 351 to the center of the base frame 130 (see FIG. 1). The roller drive shaft 352 is axially supported in the rear part of the base frame 130. Thus, the holder 356 is pivotably held in the center of the rear part of the base frame 130 (see FIG. 16). A sun gear 358 of a small diameter is fixed to the end of the drive shaft 352. The sun gear 358 meshes with a gear 355 integral with the paper-feed roller 354. With the mechanism thus constructed, when the platen 501 is reversely turned, the paper-feed roller 354, together with the paper-feed roller holder 356, is pivoted counterclockwise so as to be brought into contact with the paper P1. When the platen 501 is forwardly turned, the paper-feed roller 354 pivots clockwise as indicated by-a phantom line in FIG. 1 to thereby be separated from the paper surface.

Figure 16:
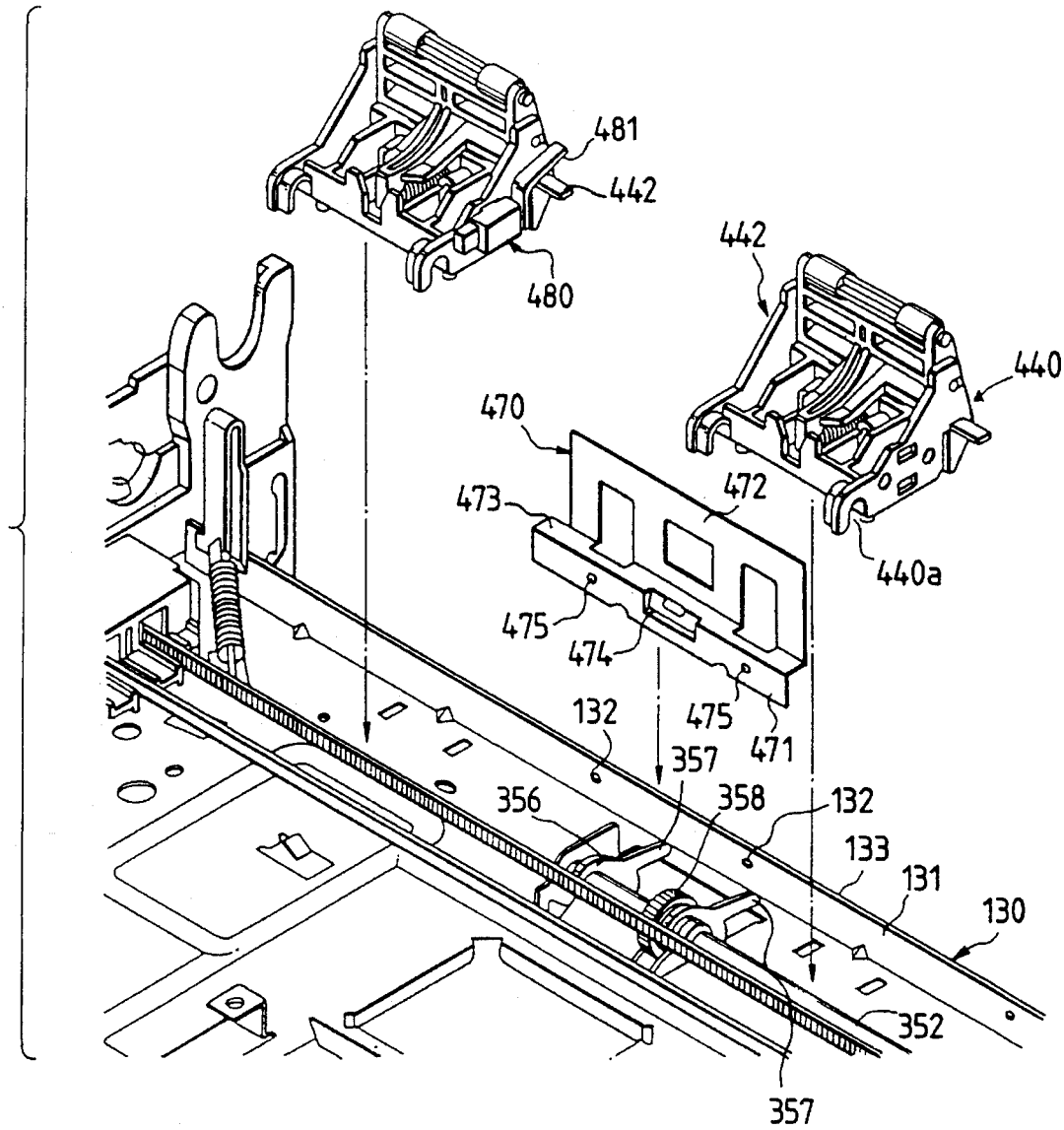
FIG. 16 is an exploded perspective view showing how the paper transport mechanism units are attached to the body frame.

The paper-feed roller holder 356 is integrally formed with stoppers 357. When the roller holder 356 is pivoted to the paper feed position, the stoppers 357 come in contact with the base frame 130, as shown in FIGS. 1 and 16, thereby preventing the paper-feed roller 354 from excessively pivoting to the paper feed position.

Figure 13:
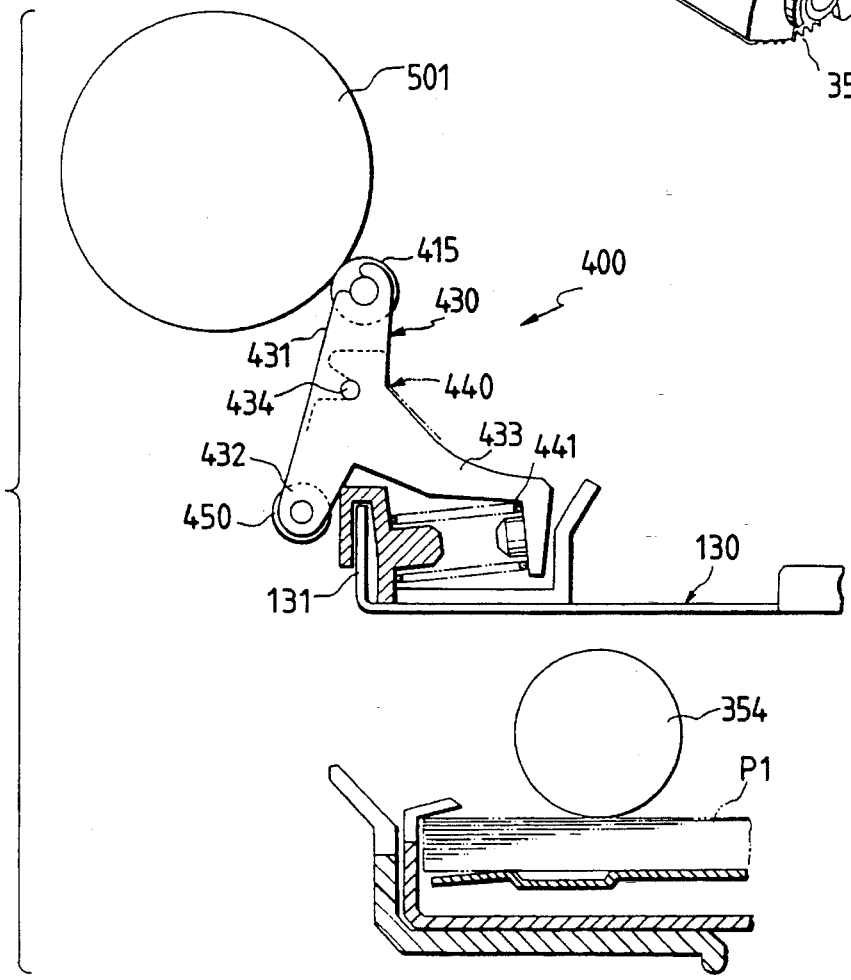
FIG. 13 is a left side view showing a paper transport mechanism.

The paper transport mechanism 400 will be described. As shown in FIG. 13, a paper hold roller 415 is rotatably supported by a lever 430. As shown also in FIG. 14, the lever 430 includes first arm portions 431, second arm portions 432 and a third arm portion 433. The lever 430 has a unitary construction shaped like a reversed Y as illustrated in FIG. 13. The lever 430 is rotatably attached to a holder 440 by means of a shaft 434 located close to the center thereof. The paper hold roller 415 is supported at the distal end of the first arm portion 431.

A compressed spring 441 is provided between the third arm portion 433 and the holder 440. The compressed spring 441 constantly urges the lever 430 counterclockwise in FIG. 13. Accordingly, the paper hold roller 415 is always urged in such a direction as to push against the platen 501. The holder 440 is mounted to a bent portion 131 of the base frame 130 and hence fastened to the base frame 130.

A tension roller 450 is rotatably supported by the second arm portions 432 of the lever 430. The tension roller 450, located between the paper hold roller 415 and the paper-feed roller 354, applies a tension to the paper being transported.

Figure 15:
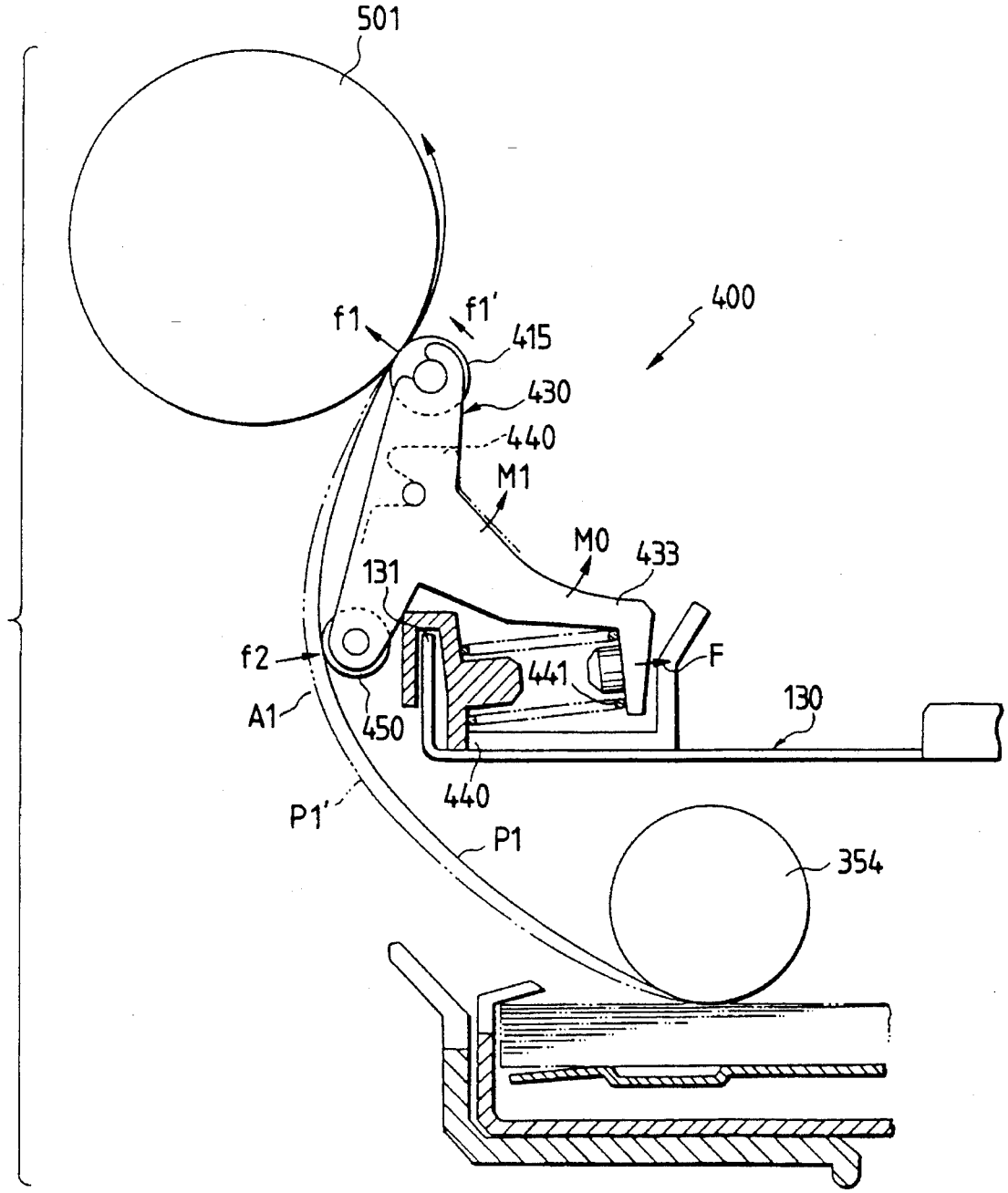
FIG. 15 is a side view for explaining the operation of the paper transport mechanism.

The operation of the paper transport mechanism 400 will be described with reference to FIG. 15.

The paper P1 fed by the paper-feed roller 354 is conveyed along paper supply path A1 and between the paper hold roller 415 and the platen 501 while being nipped therebetween. A moment M0, caused by a spring force F of the compressed spring 441 acts on the lever 430 so that the paper hold roller 415 presses the platen 501 with a force f1 creating a paper transport force. After the paper-feed roller 354 feeds the paper a predetermined distance, rotation of the paper-feed roller 354 is stopped. At this time, the roller acts as a load tending to prevent the conveyance of the paper P1 by the combination of the platen 501 and the paper hold roller 415. The paper P1 contacts the tension roller 450 as indicated by the solid line. Due to the tension created in the paper P1, the tension roller 450 receives a force f2 which generates an additional moment M1 in the lever 430. As a result, a force f1' is added to the pressure force being applied to the platen 501 of the paper hold roller 415, so that the paper transport force is correspondingly increased. Thus, when the paper-feed roller 354 acts as a load, the paper transport force is correspondingly increased, thereby ensuring reliable conveyance of the paper.

According to the present embodiment, the cassette 200 is set in the cassette receiving portion of the bottom of the printer body 100, as shown in FIG. 1. The bottom surface of the cassette 200 also forms the bottom of the printer per se. Thus, the printer size is reduced as a whole. Use of such a cassette layout provides a reliable paper feed operation, as stated above.

Figure 17:
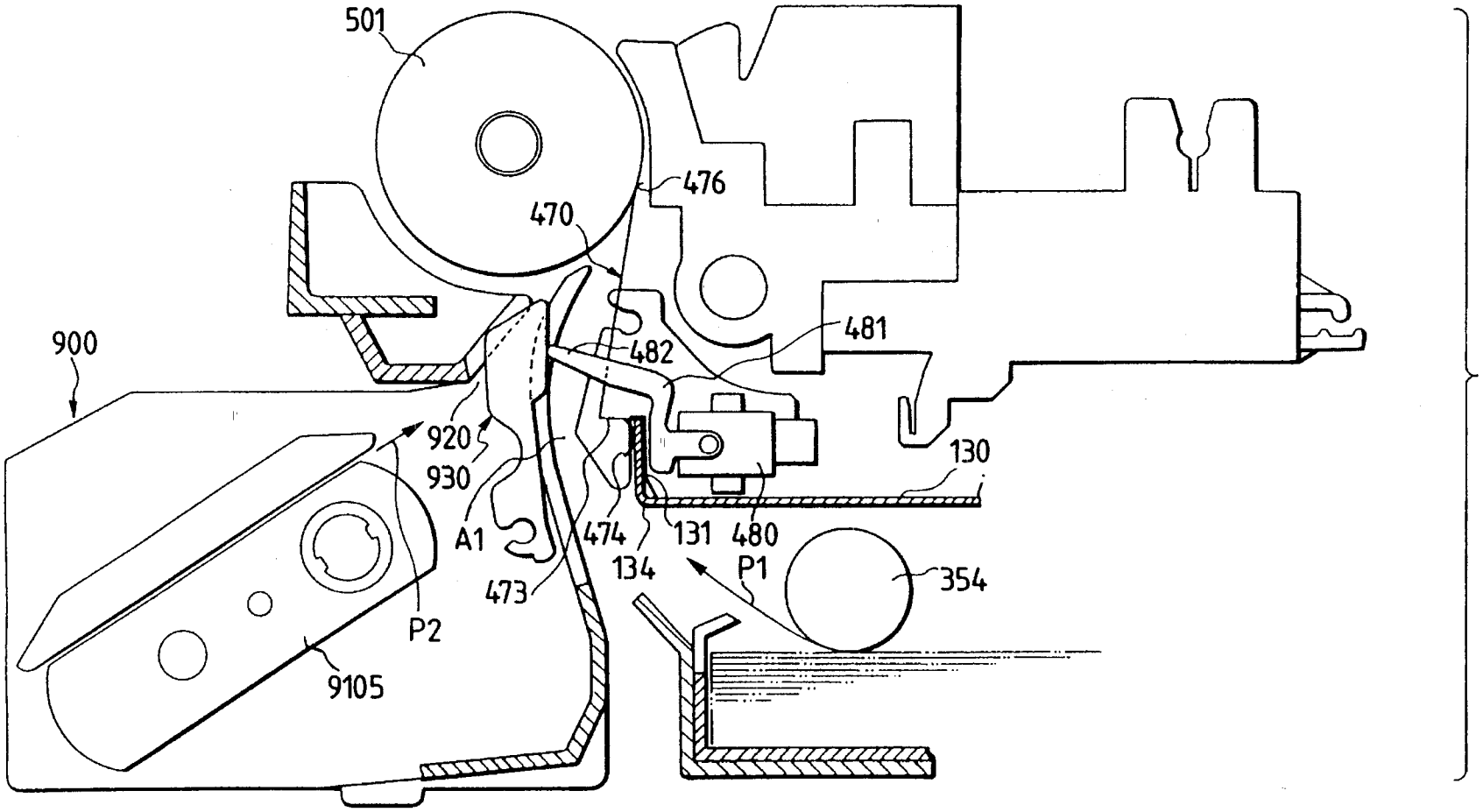
FIG. 17 is a side view, partly in cross section, showing the relationship between the paper transport mechanism and the tractor unit.

The holder 440, which supports the lever 430, performs the following functions. The holder 440 functions as a fixing member of a paper guide plate 470 as shown in FIGS. 16 and 17. The paper guide plate 470 is a single plate so shaped as to have a lower vertical part 471, an upper vertical part 472, and a horizontal coupling part 473, as shown. A temporary fixing clip 474, and temporary fixing holes 475 are formed in the lower vertical part 471. To fix the paper guide plate 470, the clip 474 is first applied to the bent portion 131 of the base frame 130, and then the holes 475 are respectively applied to the protrusions 132, which protrude from the wall of the bent portion 131. In this way, the paper guide plate 470 is temporarily fixed. Then, the holders 440 are fixed to the base frame 130. At this time, the paper guide plate 470 is fastened to the base frame 130 in such a manner that the horizontal coupling part 473 of the paper guide plate is nipped between the protruded pieces 442 of the holder 440 and the top face 133 of the bent portion 131 of the base frame 130. The fastened paper guide plate 470, as shown in FIG. 17, is designed such that the horizontal coupling part 473 juts from the bent portion 131 of the base plate, and the upper vertical part 472 upwardly extends from the jutted coupling part until the extreme end of the upper vertical part reaches the platen 501. Due to such a design, the corner 134 of the base frame is placed closer to the paper-feed roller 354. As a result, it is prevented that the leading edge of the paper P1 being fed contacts a part of the base frame bottom near the corner 134 thereof. Therefore, smooth conveyance of the paper is ensured.

Figure 14A:
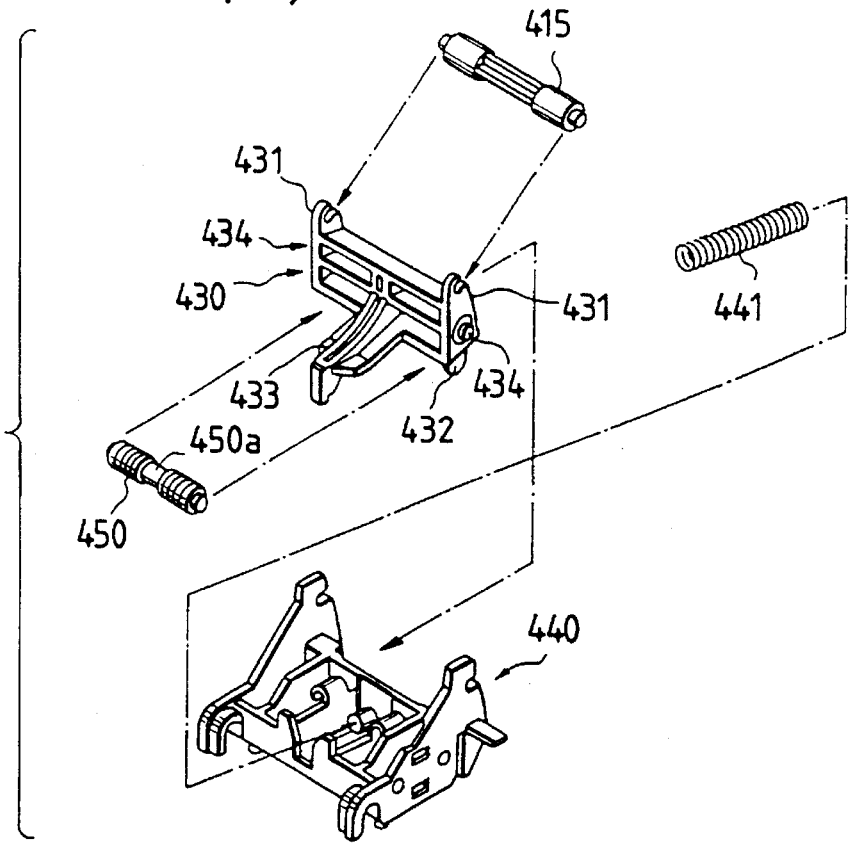
FIG. 14(*a*) is an exploded perspective view of the paper transport mechanism unit and FIG. 14(*b*) is an exploded perspective view of the paper transport mechanism unit in the assembled condition.
Figure 14B:
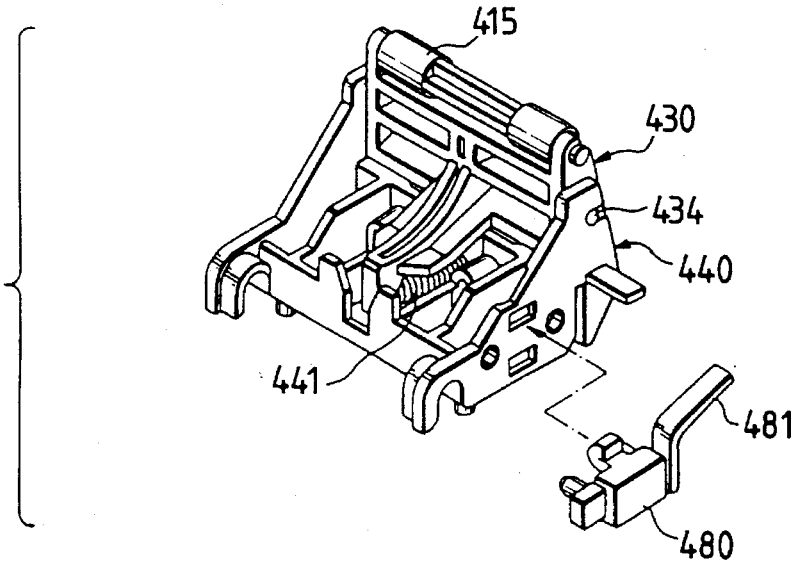

As shown in FIG. 16, the holder 440 is provided with shaft holders **440*a*, which hold the upper half part of the paper-feed roller drive shaft 352. The holder 440, as shown in FIGS. 14**(*b*), 16 and 17, serves as a member on which a paper detector 480 is mounted. In more detail, a first detect lever 481 is attached to the paper detector 480. The paper is detected in such a manner that the extreme end 482 of the first detect lever 481 comes in contact with the paper and is turned clockwise in FIG. 17. Reference numeral 900 in FIG. 17 designates a tractor unit, which is attached to the printer body 100, in place of the paper guide member 140 forming a paper guide 141 shown in FIG. 1. The tractor unit 900 is formed with a tractor 9105, a second paper feed path 920 for guiding a continuous paper P2 supplied from the tractor 9105 to the platen 501, and a second detect lever 930 rotatably located in the second paper feed path 920. The second detect lever 930 does not protrude into the first paper supply path A1 in a normal state. However, when it is contacted by the continuous paper P2, the second detect lever 930 is rotated clockwise and rotates the first detect lever 481 in the same clockwise direction. In this way, the paper is detected. The first detect lever 481 is rotatable counterclockwise in preparation for the back feed of the paper.

Figure 18:
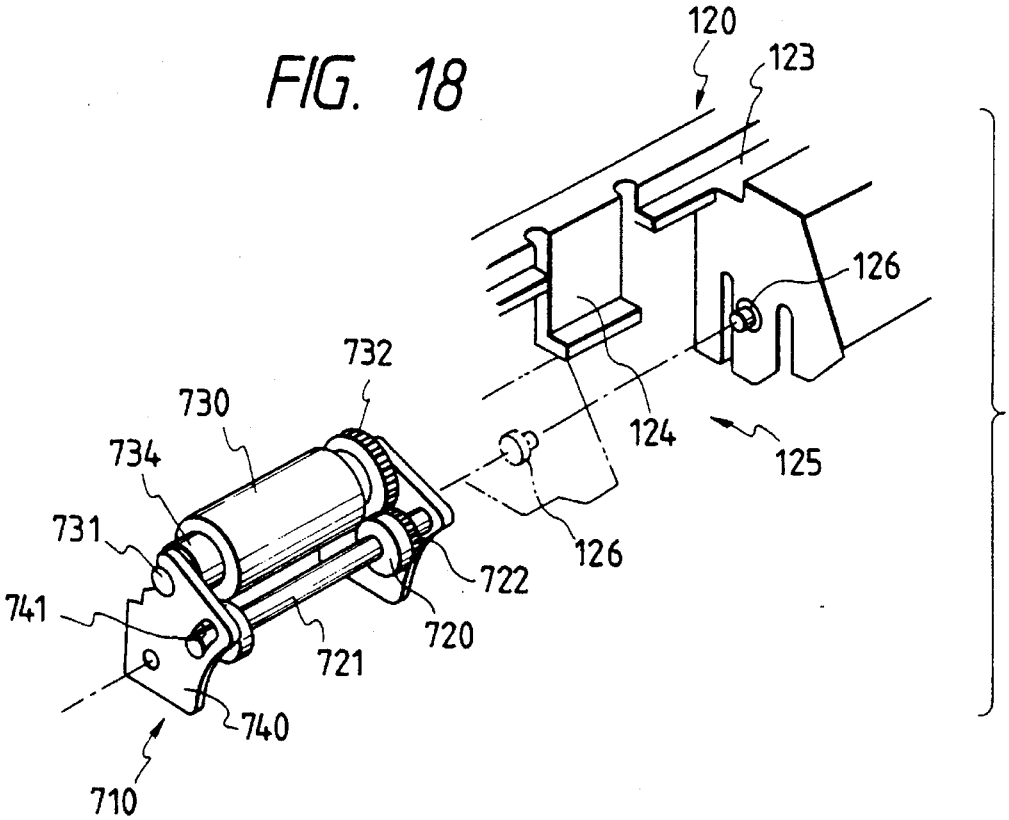
FIG. 18 is a perspective view showing a paper discharge unit.
Figure 20:
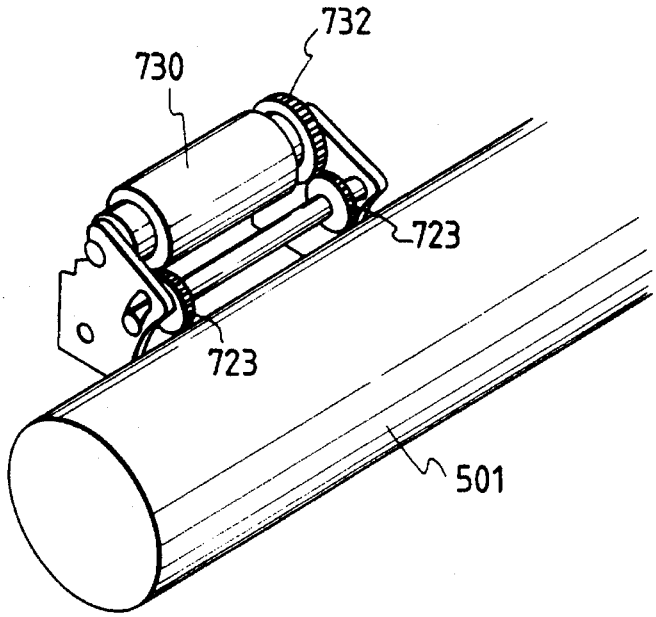
FIG. 20 is a perspective view showing another example of the discharge unit.

The discharge mechanism 700 will now be described. In FIGS. 2 and 18, a paper discharge unit 710 is formed with a discharge-paper transfer roller 720, a discharge-paper roller 730, and a roller holder 740 for holding the rollers. A gear 722 is mounted on shaft 721 which has the discharge-paper transfer roller 720. A gear 732 is mounted on shaft 731, which has the discharge-paper roller 730.

Figure 19:
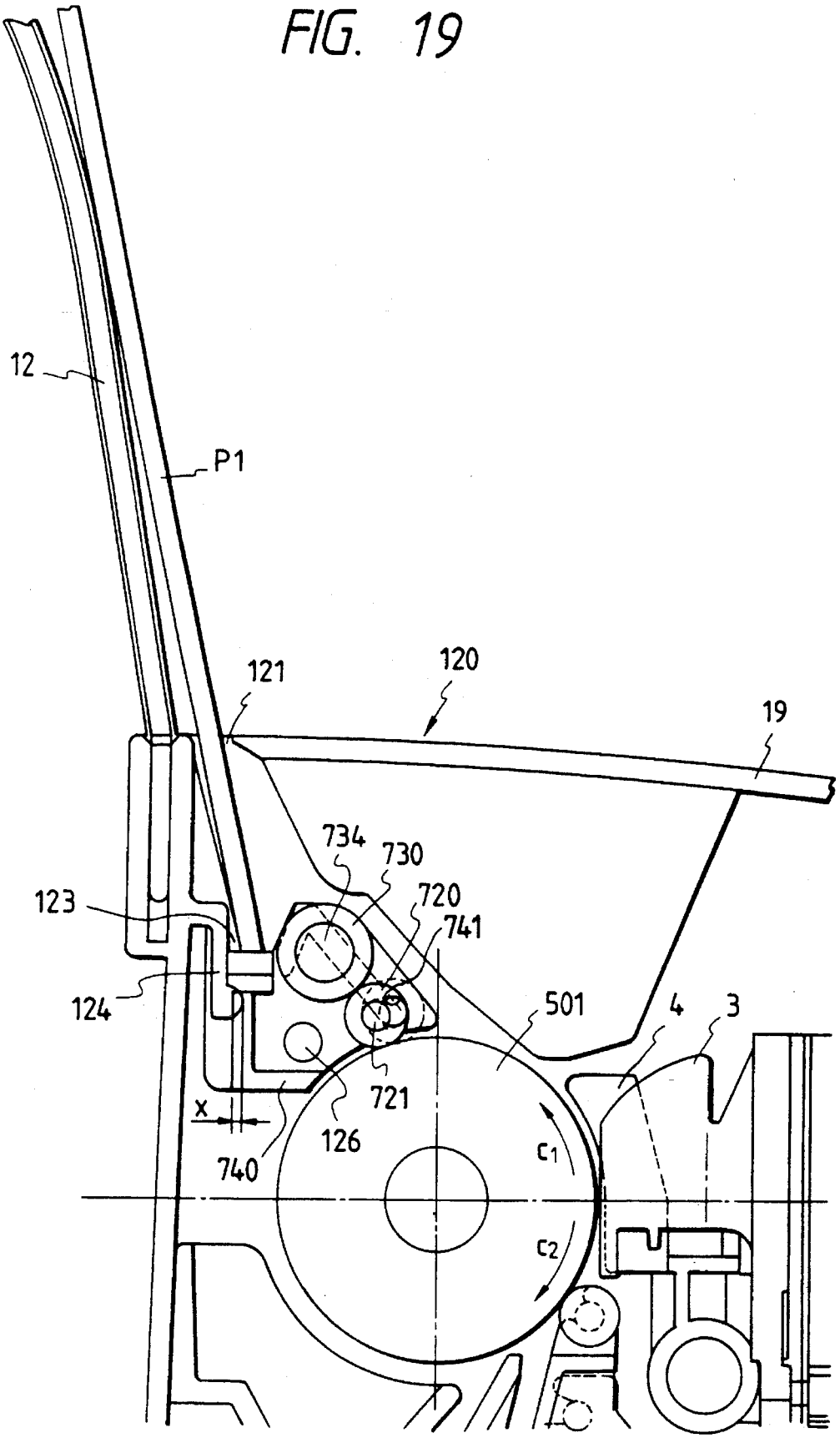
FIG. 19 is a left side view showing a paper discharge mechanism.

The paper discharge unit 710 thus constructed is mounted under the discharge port 121 on a part of the upper case 120 (see FIGS. 1 and 19). Recesses 125, in which the paper discharge units 710 are placed, are formed in the upper side of the upper case 120. Each roller holder 740 is rotatably supported by a pair of pins 126 which are planted on the opposed inner walls of each recess 125.

A tongue-like piece 124, integral with the upper case, 120 is formed in the rear side of the recess 125. The tongue-like piece 124 resiliently urges the roller holder 740 to rotate clockwise about the paired pins 126, as illustrated in FIG. 19. Accordingly, the discharge-paper transfer roller 720 is always in contact with the platen 501. In FIG. 19, a quantity of flexion of the tongue-like piece is denoted as x. The roller holder 740 has an elongated hole 741 for supporting the shaft 721 of the discharge-paper transfer roller 720. The elongated hole 741 is curved along the circumferential surface of the platen 501. Accordingly, the discharge-paper transfer roller 720 moves with respect to the platen 501 in a planetary motion.

With such a structure, when the platen 501 turns in the paper feed direction (the direction of an arrow c1 in FIG. 19), the discharge-paper transfer roller 720 moves in the same direction in a planetary, or orbital, motion, and the gears 722 and 732 engage each other. As a result, the rotating force of the platen 501 is transferred to the discharge-paper roller 730. When the platen 501 is reversely turned in the direction of an arrow c2, the discharge-paper transfer roller 720 also moves in the direction of the arrow c2 (see the phantom line), and the gear 722 disengages from the gear 732. Therefore, the rotating force of the platen 501 is not transferred to the discharge-paper roller 730. In other words, the discharge-paper roller 730 will never be turned in the reverse direction.

As shown in FIG. 19, the discharged paper P1 is placed at the bottom side in a groove 123. As shown also in FIG. 2, the groove 123, formed in the upper case 120, is located near the discharge-paper roller 730; however, such a situation will never occur where the discharged paper is pulled into and jammed in the printer.

The reason why the gears 722 and 732 are used for the power transmission between the discharge-paper transfer roller 720 and the discharge-paper roller 730 is that the pitch accuracy of the continuous paper P2 must be secured when the paper is fed backwardly.

To secure the pitch accuracy, the peripheral speed of the discharge-paper roller 730 must be increased by several % to tens of several % than that of the platen 501. To this end, in the instant embodiment, the gear 722 is integrally formed around the shaft of the discharge-paper transfer roller 720 and the gear 732 is formed around a bushing 734 to which the discharge-paper roller 730 is fixed.

Assuming that the outer diameter of the platen 501 is $\phi a$, the outer diameter of the roller portion of the discharge-paper transfer roller 720 is $\phi b$, the pitch circle diameter of the gear 722 of the discharge-paper transfer roller 720 is $\phi d$, the pitch circle of the gear 732 is $\phi c$, the outer diameter of the discharge-paper roller 730 is $\phi e$, and the peripheral speed of the platen 501 is Vp, the peripheral speed Vr of the discharge-paper roller 730 is:

$$Vr=Vp\{(a/b)\times(c/d)\times(e/a)\}=Vp\{(c/b)\times(e/d)\}.$$

These factors are selected so as to satisfy $(c/b)\times(e/d)>1$. It is noted that (c/b) is always smaller than 1 to avoid the contact of the gear 722 to the platen 501. In order to obtain $Vr>Vp$, (e/d) must be increased till $(c/b)\times(e/d)>1$. Increase of the outer diameter $\phi e$ of the discharge-paper roller 730 narrows the gap between it and the discharge-paper transfer roller 720. As a result, the center-to-center distance between the rollers 730 and 720 must be increased, bringing about increase of the printer size. To avoid this, (c/b) must be increased as large as possible. A maximum value of (c/d) can be obtained by the largest diameter of the gear 723 close to the platen 501.

Figure 21:
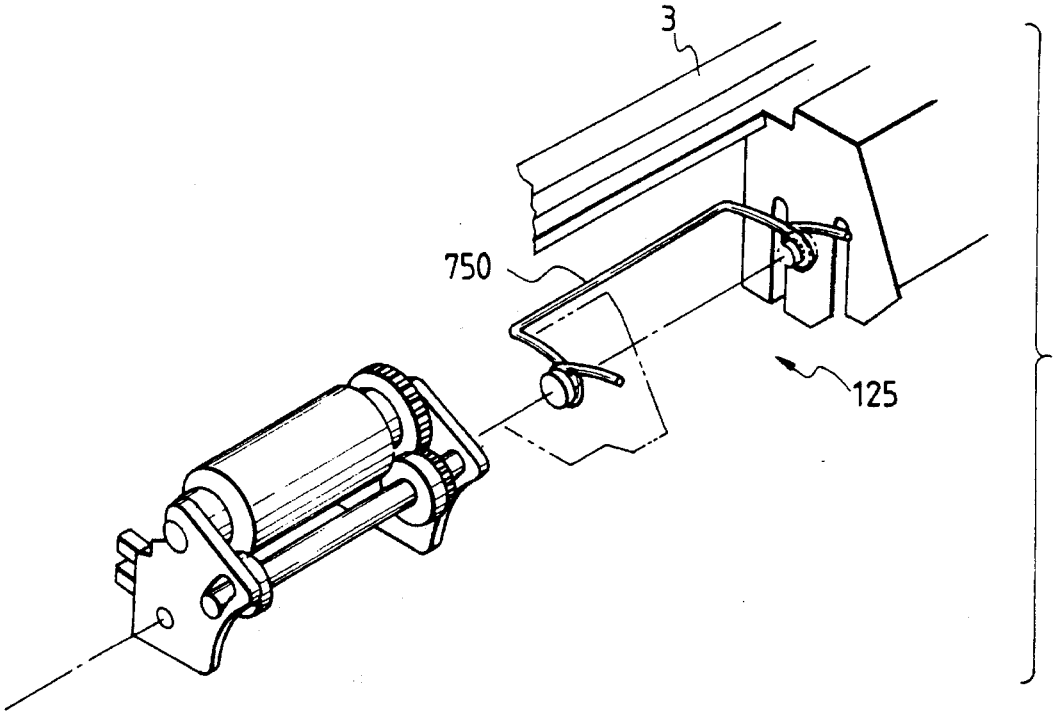
FIG. 21 is a perspective view showing yet another example of the discharge unit.
Figure 22B:
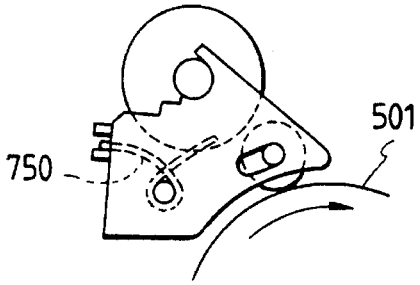
FIGS. 22(*a*) and 22(*b*) are side views for explaining the operation of the discharge unit.
Figure 22A:
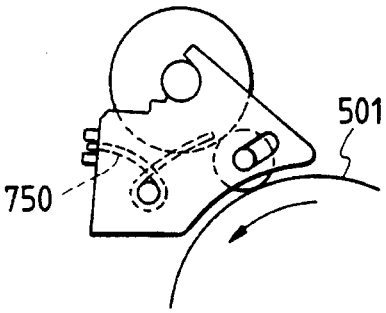

The means for urging the roller holder 740 toward the platen 501 may be a spring 750, as shown in FIGS. 21 and 22. If material having a high friction efficient is used for the surface region of the discharge-paper transfer roller 720 which is brought into contact with the platen 501, decrease of the pressure force of the discharge-paper transfer roller 720 is allowed. Any known urging means may be used. In other words, its weight serves as the urging means.

The structure for jam removal will be described. As shown in FIG. 1, in the lower case 110 of the printer, a first cover 140 is removably attached facing the upstream region (paper supply path) A1 of the print stage A. In the upper case 120, a second cover 150 is removably attached facing the downstream region (paper discharge path) A2 of the print stage A.

Figure 23:
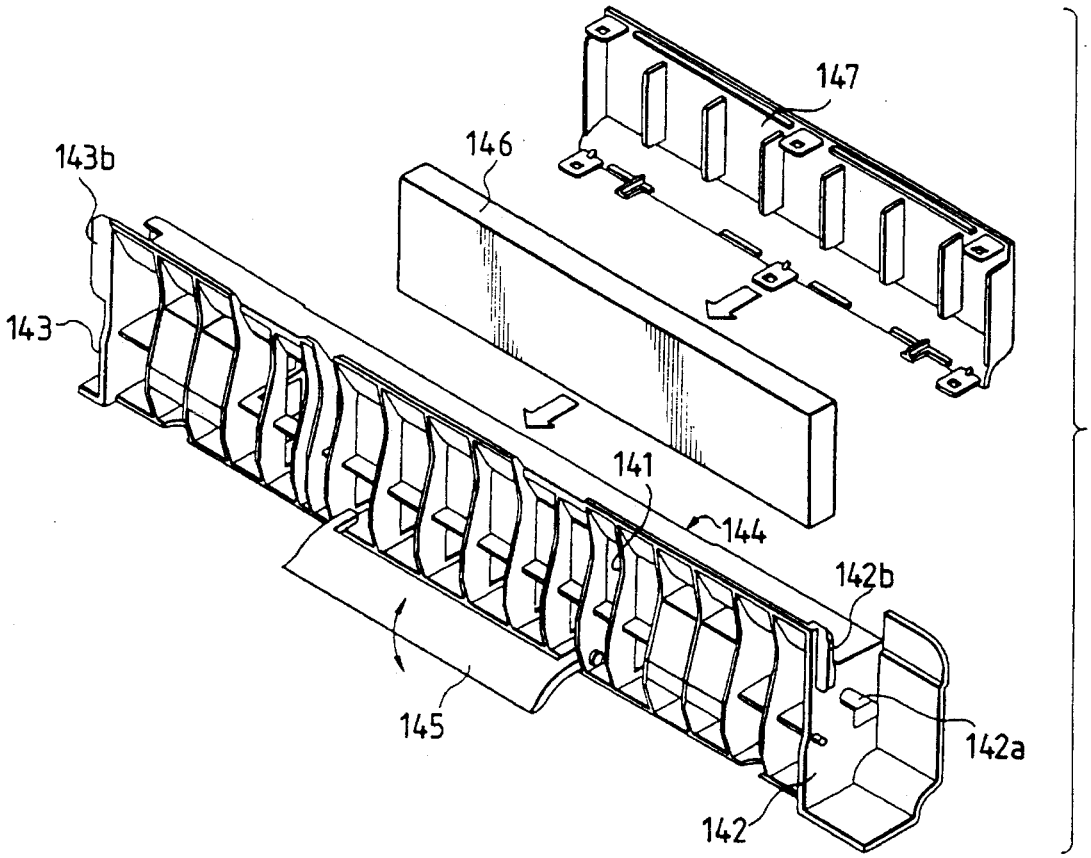
FIG. 23 is an exploded perspective view showing a first cover.
Figures 24A, 24B, 24C:
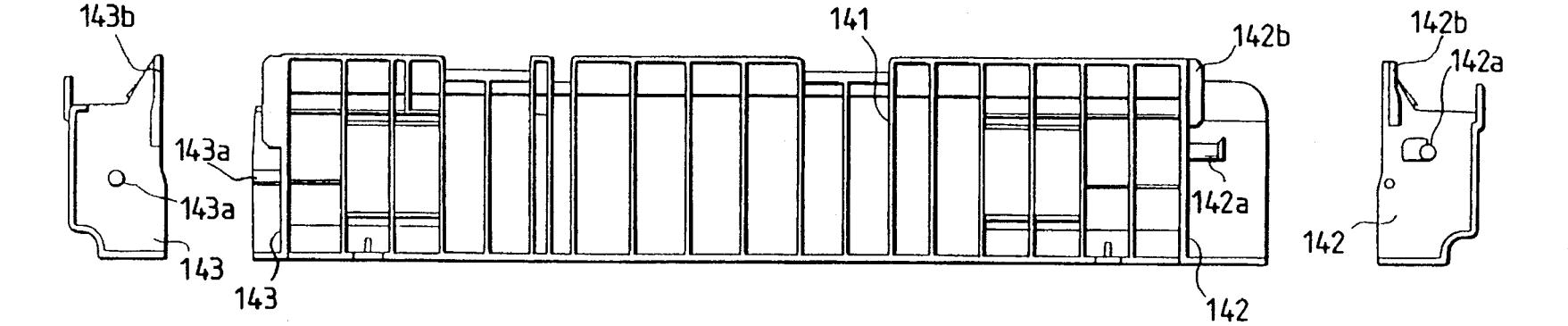
FIGS. 24(*a*), 24(*b*) and 24(*c*) are front, left side, and right side views showing the first cover.
Figure 26:
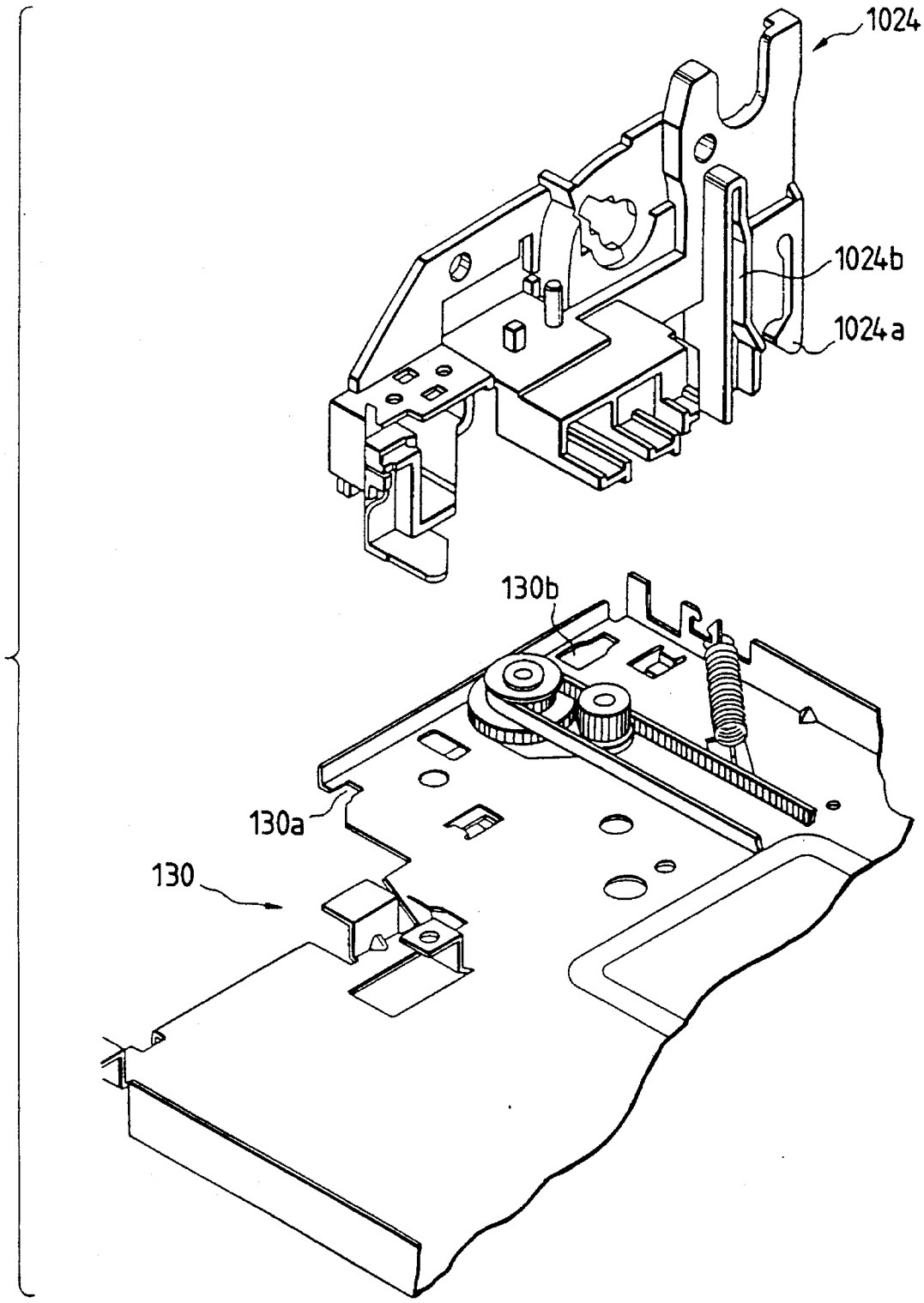
FIG. 26 is a perspective view showing in part a left side frame and a base frame.

The first cover 140, as shown in FIGS. 23 and 24, includes a paper guide portion 141 partly defining the paper supply path A1, side portions 142 and 143, a rear portion 144, and a backout guide 145. An outer plate 147 is mounted on the rear portion 144, with a sound absorber 146 interposed therebetween. A pin **142*a* and a mounting guide 142*b* are protruded from the side portion 142. Similarly, a pin 143*a* and a mounting guide 143*b* are protruded from the side portion 143. To attach the first cover 140, as shown in FIGS. 25A–25C, the mounting guide 142*b* of the side portion 142 is inserted into a guide groove 1023*b* formed in the side frame 1023 of the main body. Similarly, the mounting guide 143*b* of the side portion 143 is inserted into a guide groove 1024*b* formed in the side frame 1024 of the printer body. Further, the pin 142*a* of the side portion 142 is fitted into a hook 1023*a* of the side frame 1023 and the pin 143*a* of the side portion 143 is fitted into a hook 1024*a* of the side frame 1024**.

The side frame 1023 is fastened to the base frame 130 in such a manner that an engaging protrusion (**1023*c* in FIG. 10) provided at the bottom thereof is fitted into a hole 130*a* of the base frame 130. Similarly, the side frame 1024 is fastened to the base frame 130 in such a manner that an engaging protrusion provided at the bottom thereof is fitted into a hole 130*b* of the base frame 130**.

The first cover 140, when it is attached to the printer body, defines the paper supply path A1, as shown in FIG. 1. The backout guide 145, as will be described in detail, guides the paper reversely passing through a reverse paper-transport path A3 into a space S located between the bottom surface of the printer and the placement surface F, when the paper is transported in the reverse direction. When the printer is placed upright, the backout guide 145 serves as a guide for the manually inserted paper P1, as shown in FIG. 27.

The second cover 150 consists of a large cover 151 and a small cover 152. The small cover 152 is removably attached to the large cover 151. The large cover 151 consists of a ceiling plate 153 and side plates 154 integral with the ceiling plate. A paper guide portion 155 is formed on the rear side of the ceiling plate 153. The paper guide portion 155 cooperates with a paper guide 156 formed on the rear side of the small cover 152 to form the paper discharge path A2.

Engaging pieces 157, as shown in FIG. 29B, are protruded from two locations near both sides of the rear end of the large cover 151. An engaging piece 158 is also protruded from the inner side of the side plate 154 as shown in FIG. 1.

The second cover 150, as shown in FIG. 29A, is attached to the case of the printer body in such a manner that the engaging pieces 157 (one piece alone being illustrated) on the rear end of the large cover are fitted into engaging holes 120*a* formed in the upper case 120, and the engaging pieces 158 on the inner sides of the side plates are fitted into engaging holes 120*b* of the upper case 120, as shown also in FIG. 1. Reference numeral 159 indicates a knob for removing the cover, in FIG. 29A.

The thus constructed structure for jam removal provides easy access to the jam positions. When a jam occurs at a position in the downstream region A2 of the print stage A, the second-cover 150 is removed. Then, as shown in FIG. 28, the platen 501, the print head 601, and the discharge-paper roller 730 are exposed to the outside of the printer. Accordingly, a user or service man can readily access the jammed position. When a jam occurs at a position in the upstream region A1 of the print stage A, the user, for example, removes the first cover 140 and can directly see the inner part including the platen 501, the paper hold roller 415, and the tension roller 450. Therefore, the user can readily remove the jammed paper.

It is further noted that in the instant embodiment, the first cover 140 forms the upstream, paper guide portion 141, and the second cover 150 forms the downstream, paper guide portions 155 and 156. With such a structure, if those covers 140 and 150 are removed, the paper guide is also removed. Accordingly, the structure further facilitates the access to the jam trouble position.

It is noted again that the covers 140 and 150 are attached to and detached from the printer body not accompanied by any part in the print stage, the paper feed mechanism, or the paper discharge mechanism. Therefore, these mechanisms will not be effected.

The discharge tray 800 and its related portions will now be described. As shown in FIG. 1, the upper surface 100*c* of the printer body 100 is tilted downwardly to the right. A concavity 100*g*, which is defined by three slanted walls 100*e*, 100*e* and 100*f*, is formed on the upper surface 100*c*, as illustrated in FIG. 30A.

Figure 31:
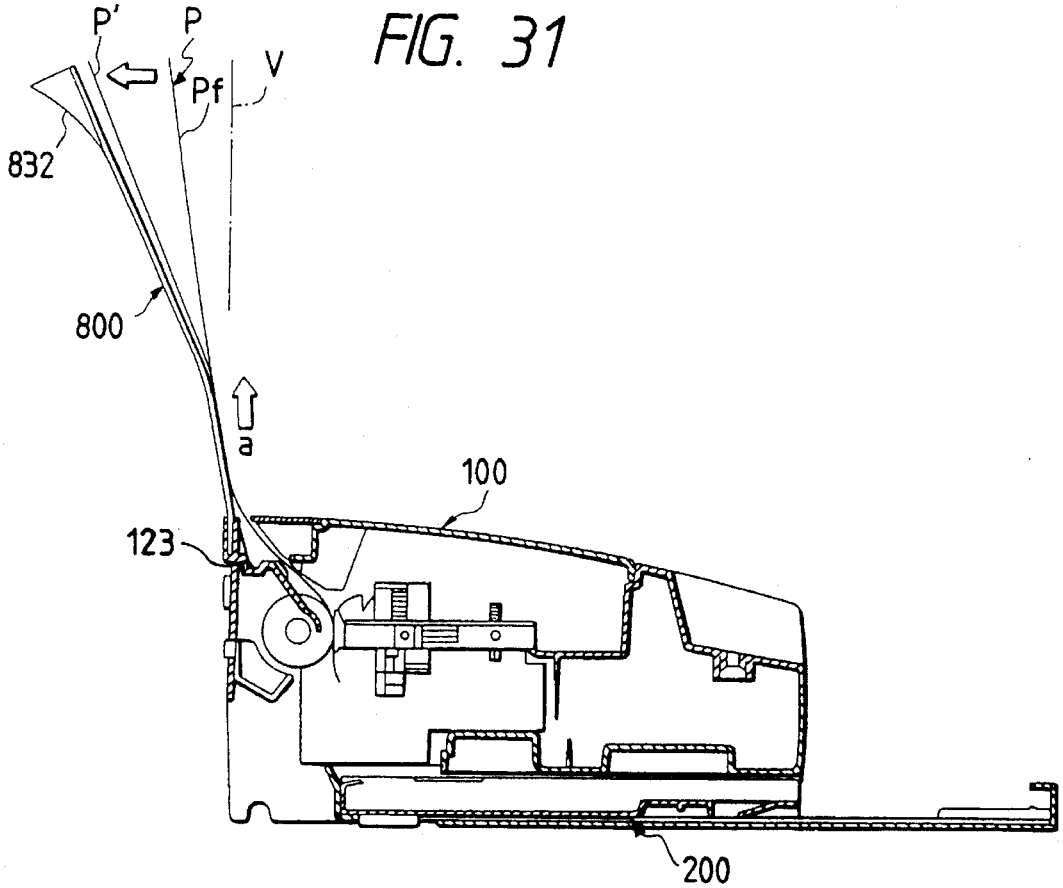
FIG. 31 is a side view for explaining the operation of the discharge tray.

The discharge tray 800, as shown in FIG. 31, is attached to the printer body 100 by inserting protruded portions 831 into mounting holes 100*d* of the case of the printer body (see FIG. 30B). The discharge tray is bent in the middle thereof when viewed from the side. The protruded portions 831 are protruded from the bottom side of the tray. A paper guide portion.832 is formed on the rear side of the discharge tray (see FIG. 33).

Figure 32:
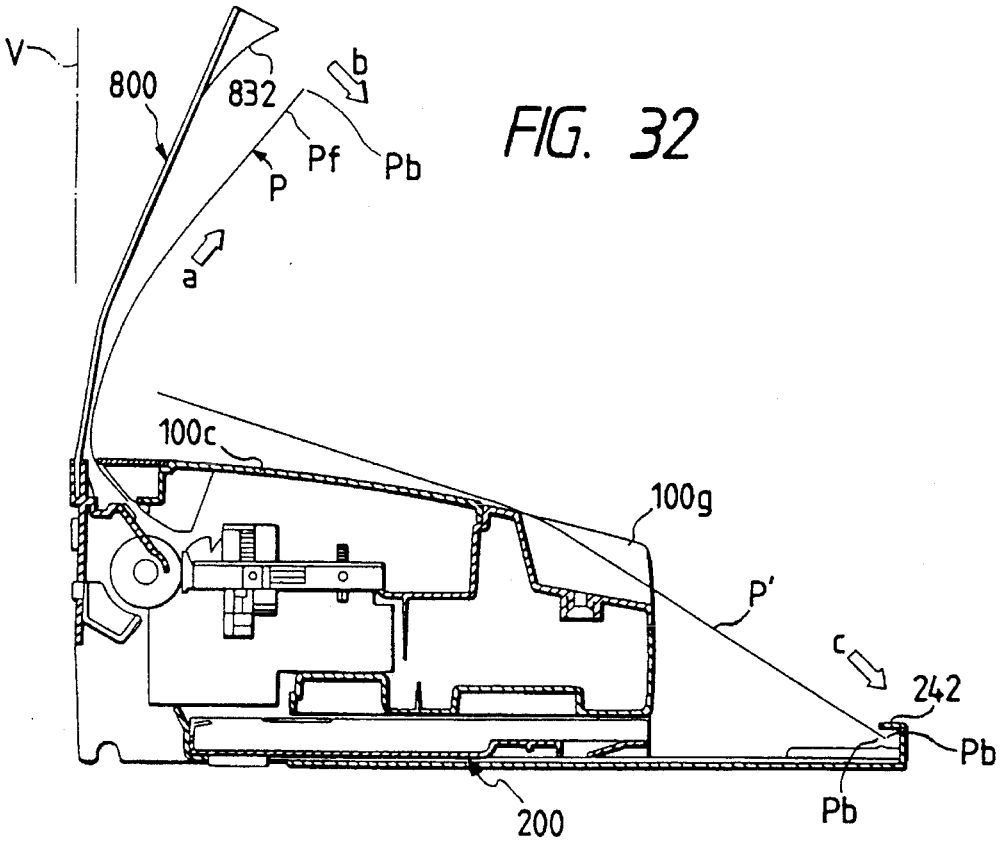
FIG. 32 is a side view for explaining the operation of the discharge tray.

The discharge tray 800, as shown in FIG. 31, is tilted rearwardly of the printer with respect to the vertical direction V, when it is attached to the printer body 100. It may be attached to the printer body in a inverted state, as shown in FIG. 32. In this case, it is tilted forward of the printer body with respect to the vertical direction V.

The functions of the discharge tray thus constructed are as follows. As shown in FIGS. 30A, 30B and 31, when the discharge tray 800 is attached to the printer body 100 in a state that it is tilted rearwardly of the printer with respect to the vertical direction V, the paper P after being printed is guided by the discharge tray 800 in the direction of arrow a in a state that the printed surface Pf of the paper faces upward. After being further discharged, the printed paper denoted as P' is placed on the discharge tray 800. Accordingly, a user can see the printed side of the paper P'.

When the discharge tray 800 is tilted forwardly of the printer body 100 with respect to the vertical direction V, the printed paper P is guided by the discharge tray 800 in the direction of an arrow a in a state that the printed surface Pf thereof faces slightly downward. Then, it is turned over as indicated by an arrow b in FIG. 32. The turning-over action of the printed paper is reliably performed by means of the paper guide portion 832. The turned-over paper P' slides down along the upper surface 100*c* of the printer body in the direction of an arrow c, and stops when the leading edge Pb of the paper abuts against a paper stopper 242 of the cassette 200.

Accordingly, in this case, the paper is stored in such a state that the printed surface Pf thereof faces downward. Therefore, less time is attained for arranging the page numbers of the printed papers thus stored in the correct order. Further, since the printed surface Pf of the paper faces slightly downward until it is turned over, a user can see the printed visual information on the paper.

Since the concavity 100*g*, which is formed on the upper surface 100*c*, is defined by the three slanted walls 100*e*, 100*e*, and 100*f*, the papers P are orderly arranged in the central part when sliding drawn along the upper surface 100*c*. In this way, the storing mode of the printed papers can be selected by a user.

When the printer is used in an upright state, the discharge tray 800 is attached to the printer body as shown in FIGS. 32 and 33.

The reverse paper-transport path will now be described.

The printer of the present embodiment makes communication and cooperates with a user to set the environment of the printer that require the reverse paper feed. In FIG. 1, the reverse paper-transport path A3 is used to transport the printed paper P1 in the reverse direction, for example, when the environment of the printer is set.

The reverse paper-transport path A3 is branched, at a branch point A5, from the paper supply path A1. A discharge port 111 of the reverse paper-transport path A3 is directed so as to guide the paper toward the space S between the printer placement surface F and the printer bottom surface 100*a*, as indicated by arrow a in FIG. 1. In this embodiment, the extreme end 145*b* of a manual inserter guide 145 rotatably supported by a shaft 145*a* partially forms the discharge port 111. With the extreme end 145*b*, the paper is guided into the space S between the printer placement surface F and the printer bottom surface 100*a*.

The manner in which the environment of the printer is set with making communication between the printer and user will now be described. Initially, the paper P1 is supplied from the cassette 200, and wound around the platen 501, which rotates in the direction of the arrow $c_1$. Transportation of the paper P1 is continued until the trailing edge of the paper has passed the branch point A5 for the paper supply path A1 and the reverse paper-transport path A3. Then, the platen 501 turns in the reverse direction (i.e., the direction of the arrow c2) to move in the reverse direction until the leading edge of the paper P1 reaches the print stage A. At this time, since the trailing edge of the paper moves, with its elasticity, along the path wall 141, it naturally enters the reverse paper-transport path A3 after passing the branch point A5, and enters, by way of the discharge port 111, the space S between the printer placement surface F and the printer bottom surface 100*a*. When the paper reverse transport stops, a first message to the user is printed on the paper by the print head 601. Then, the platen 501 moves forwardly (in the direction of the arrow c1), to transport the printed paper until the printed message comes out of the discharge port 121 and reaches a position A6 where the first message printed on the paper is presented to a user. The user operates related keys on an operation panel 120P (see FIG. 2) according to the instructive contents in the first message. Thereafter, the paper is returned to the print stage A where a second message is printed thereon. Then, the paper is moved to the position A6 where the second message printed on the paper is presented to the user. Repeating the sequence of above operations completes the setting of the printer environment.

When the printer is placed upright, the discharge port 111 of the reverse paper-transport path A3 is located at the rear side, as shown in FIG. 27. When the paper P1 is supplied from the discharge port 111 as indicated by an arrow b, the reverse paper-transport path A3 can be used as a second paper supply path. In this case, the manual inserter guide 145 is opened (clockwise), as shown in FIG. 27. The paper P1 supplied is transported through the reverse paper-transport path A3 and the paper supply path A1 to the print stage A where it is printed. After being printed, the paper is moved through the paper discharge path A2 and discharged from the discharge port 121 into the discharge tray 800.

When the printer is laterally placed (as shown in FIG. 1), the manual inserter guide 145 abuts against the printer placement surface F, and is rotated counterclockwise by the surface. It partially forms the discharge port 111 of the reverse paper-transport path. Accordingly, even when the printer is used in the lateral placement, the manual inserter guide 145 is not obstructive.

The metal partitioning plate 1060 also functions to prevent the electrical parts from entering the mechanism M.

With the reverse paper-transport path structure, the paper reversely transported after having been printed passes through the reverse paper-transport path A3 and enters the space S between the printer placement surface F and the printer bottom surface 100*a*. In this case, the space S between the printer placement surface and the printer bottom surface serves as another paper reverse-transport path. Accordingly, there is no need of elongating the reverse paper-transport path A3 of the printer per se. In other words, the quantity of reverse-feeding of paper can be increased. Further, reduction of the printer size is realized.

When the printer is used in the upright placement, the reverse paper-transport path A3 can be used as a second paper supply path. Accordingly, the printer may be further efficiently used. The provision of the manual inserter guide 145 further enhances the function of the reverse paper-transport path A3 as the second paper supply path.

The manual inserter guide 145 can be omitted if the discharge port 311 directs the paper toward the space between the printer placement surface and the printer bottom surface. In this embodiment, the case of setting the printer environment with making communication between the printer and user was used in the situation where the printed paper had to be transported in the reverse direction. However, it is evident that the present invention is applicable for any type of printer requiring a reverse-transport of the printed paper.

The platen gap (PG) and the carriage position detection device will now be described. Referring to FIG. 2, the carriage guide shaft 633 is rotatably supported, in an eccentric manner, by the side frames 1023 and 1024. Accordingly, by turning the carriage guide shaft 633, a gap (platen gap) between the print head 601 mounted on the carriage 600 and the platen can be varied.

Figure 34A:
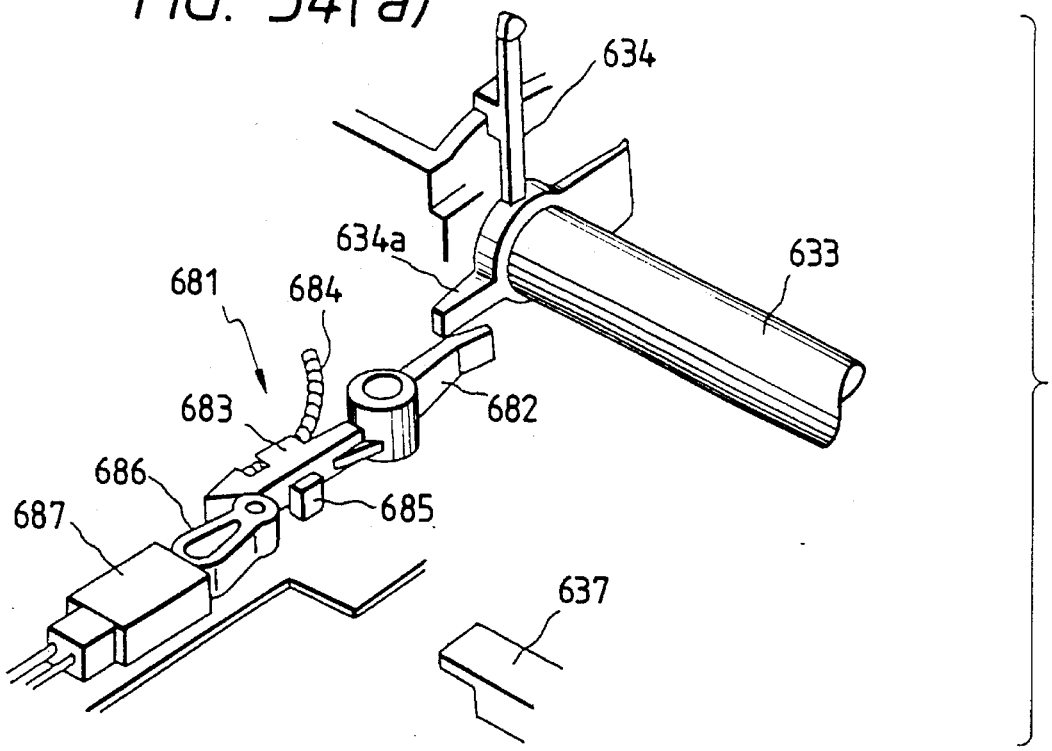
FIGS. 34(*a*) and 34(*b*) are perspective views showing a platen gap/home position detect mechanism.
Figure 34B:
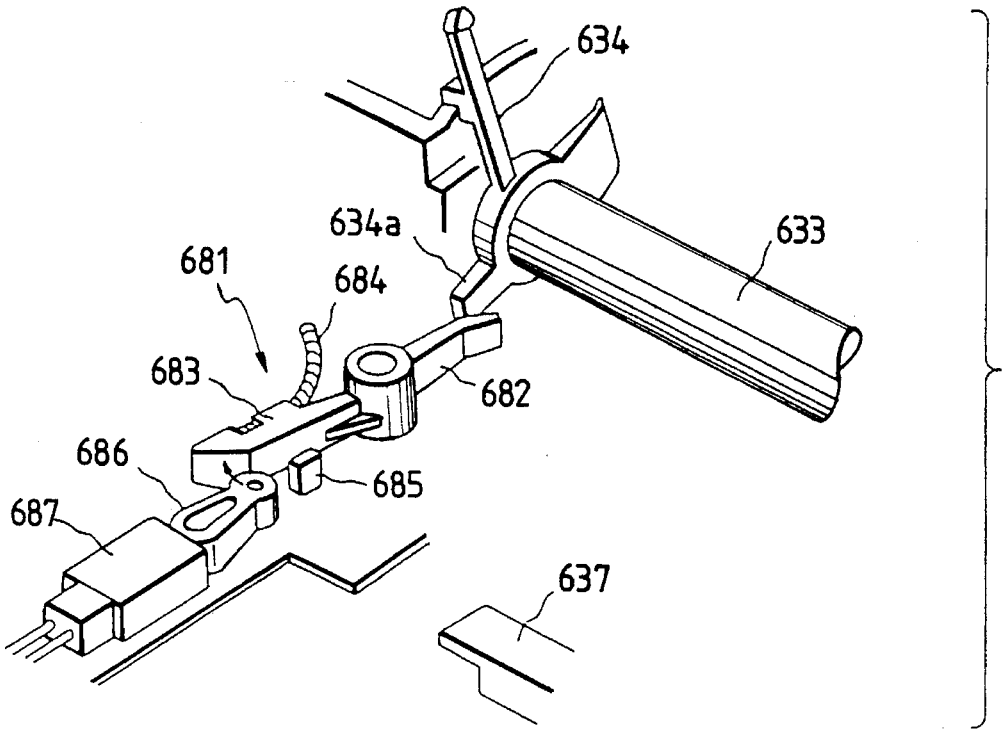

As shown in FIGS. 2 and 34, a platen gap lever 634 is secured to one end of the carriage guide shaft 633. A platen gap for normal paper or a platen gap for thick paper is selected by manually turning the platen gap lever 634. Specifically, when the platen gap lever 634 is turned to a position shown in FIG. 34(*a*), the normal paper platen gap is selected. When it is turned to a position shown in FIG. 34(*b*), the thick paper platen gap is selected.

In the printer of this embodiment, a home position (HP) of the carriage 600 is present in the vicinity of the platen gap lever 634. Accordingly, a single detector 687 can detect the selected platen gap and arrival of the carriage 600 at the home position.

In FIG. 34, a PG/HP detector unit is designated by reference numeral 681. The PG/HP detector unit 681 is comprised of a platen gap detect lever 682, a displacement transfer lever 683, a carriage detect lever 686, and the detector 687. The platen gap detect lever 682 is for detecting two platen gap positions to which the platen gap lever 634 is turned. When the platen gap detect lever 682 turns, the displacement transfer lever 683 turns in unison. As a result, the lever 683 is displaced so as to determine the range within which the carriage detect lever 686 turns. The carriage detect lever 686 contacts a protrusion 637 of the carriage 600 when the carriage 600 returns to the home position, and is displaced by the protrusion. The detector 687 detects the displacement of the carriage detect lever 686.

When the platen gap lever 634 is turned from the normal paper position (FIG. 34(*a*)) to the thick-paper position (FIG. 34(*b*)), the platen gap detect lever 682 is contacted by the arm 634*a* of the platen gap lever 634 and turns. As a result, the displacement transfer lever 683 is turned away from the carriage detect lever 686.

The displacement transfer lever 683 is constantly urged by a spring 684 so as to retain the carriage detect lever 686 at a contact OFF position A (see FIG. 35), while it is in contact with a stopper 685. When the transfer lever 683 rotates as shown in FIG. 34(*b*) and 35, the carriage detect lever 686 is able to rotate to position B.

Figure 35:
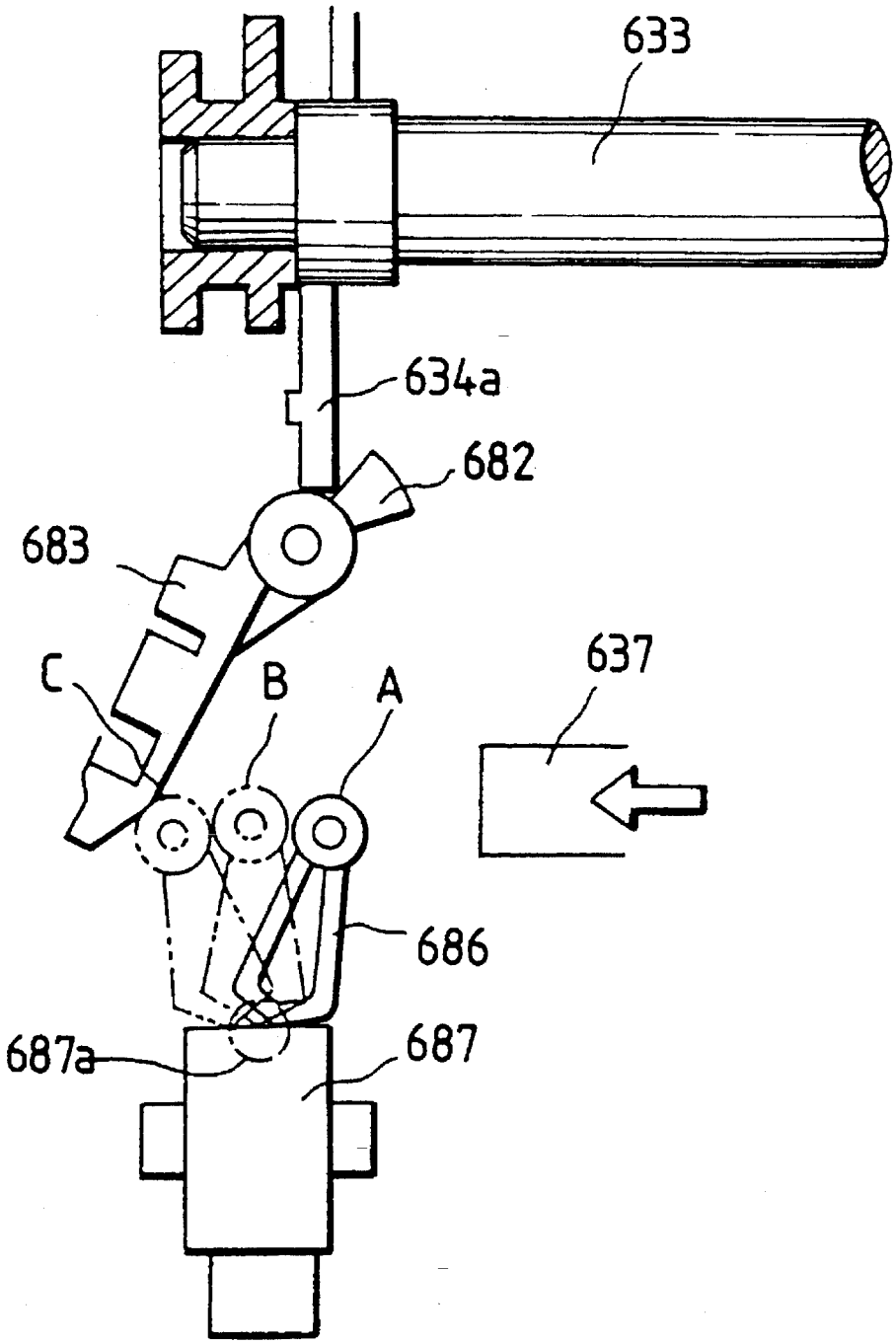
FIG. 35 is a plan view showing the platen gap/home position detect mechanism.

The carriage detect lever 686, as shown in FIG. 35, may be rotated about a fulcrum 687*a* within the detector 687 so as to be set to three positions A, B and C. With a spring (not shown) within the detector 687, the carriage detect lever 686 is kept at the neutral position B unless it receives an external force. The detector 687 outputs signals of L, H, and L according to the positions A, B and C of the lever 686. Those signals are applied to a CPU mounted on the control board 1050. According to the L, H and L signals, the CPU determines the selected platen gap and the arrival of the carriage 600 at the home position in the following manner.

When the selected platen gap is for the normal paper, the platen gap lever 634 is at the position shown in FIG. 34(*a*). Accordingly, the carriage detect lever 686 is at the position A. Under this condition, the detector 687 produces an L signal. Upon receipt of the L signal, the CPU determines that the selected platen gap is for the normal paper. When the carriage 600 reaches the home position, the lever 686 is pushed by the protrusion 637 of the carriage, so that its position changes in the order of A→B→C. Accordingly, the signal level changes in the order of L→H→L. On the basis of the level change, the CPU determines that the carriage 600 has reached the home position. Further, it recognizes the position where the signal level change from H to L, H→L, as the home position.

When the selected platen gap is for the thick paper, the platen gap lever 634 is at the position shown in FIGS. 34(*b*) and 35. Accordingly, the carriage detect lever 686 is at the neutral position B. Under this condition, the detector 687 produces an H signal. Upon receipt of the H signal, the CPU determines that the selected platen gap is for the thick paper. When the carriage 600 reaches the home position, the lever 686 is pushed by the protrusion 637 of the carriage, so that its position changes from B to C, B C. Accordingly, the signal level changes from H to L, H→L. On the basis of the level change, the CPU determines that the carriage 600 reaches the home position. Further, it recognizes the position where the signal level change from H to L, H→L, as the home position. Since the selected platen gap is detected when the carriage is present at any other positions than the home position, the CPU will not confuse the detection of the selected platen gap with the home position detection.

In the detect system thus constructed, both the platen gap and the carriage position can be detected with a single detector. This feature contributes to a decrease in the number of parts.

Figure 36:
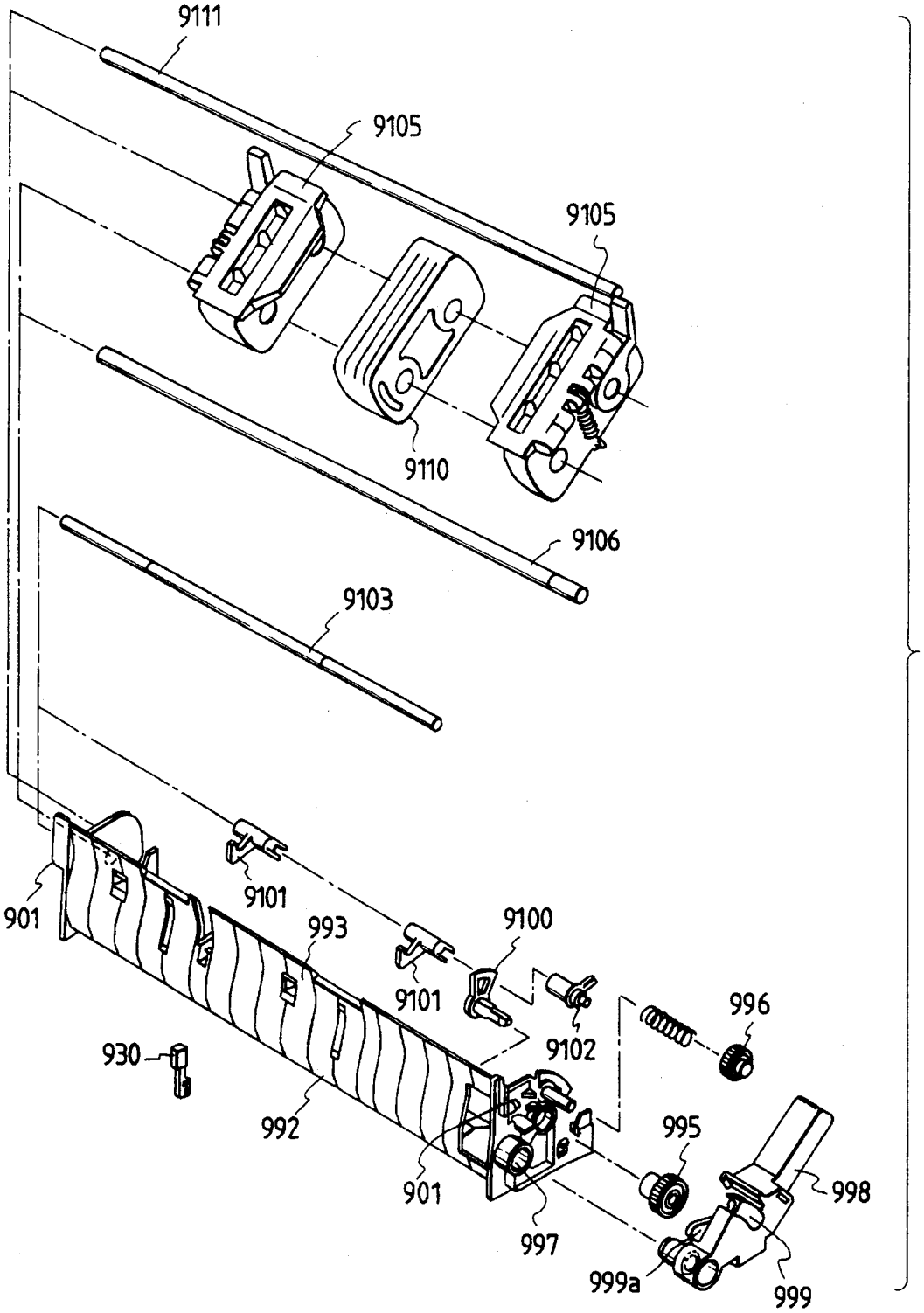
FIG. 36 is an exploded perspective view of a tractor unit.

The tractor unit 900 will now be described. In FIG. 36, reference numeral 992 designates a frame of the tractor unit 900. Pins and mounting guides (only the guide 901 is illustrated in FIG. 36), which respectively resemble the pins 142*a* and 143*a* and the mounting guides 142*b* and 143*b*, which are formed on both sides of the first cover 140 (see FIGS. 23 and 24), are formed on both sides of the frame 992 of the tractor unit. Since the tractor unit 900 is thus structured, it can be attached to the printer body 100, in place of the first cover 140.

The front side 993 of the frame 992 is shaped like the paper guide portion 141 of the first cover 140. When attached to the printer body, it forms one side of the paper supply path A1.

A release gear 996 is axially slidably mounted on the frame 992. The release gear 996 couples the tractor transmission gear 349 (see FIG. 10) of the printer body with a tractor gear 995 on the frame 992. A release lever 998 is rotatably fastened to a receiver 997. A cam surface 999, which functions to axially displace the release gear 996, is provided at the location of the release lever 998 which faces the release gear 996. When the release lever 998 is turned counterclockwise in FIG. 10 (to a position indicated by the solid line), the release gear 996 engages with the tractor gear 995 by the action of the cam surface 999. When it is turned clockwise (to a position indicated by the broken line), the release gear 996 disengages from the tractor gear 995. Release cams 9101, which each engage with and disengage from the shaft part 450*a* of the tension roller 450 (see FIG. 14), are mounted around a release shaft 9103. A pinion 9102 of the release shaft 9103 is in mesh with a sector 9100 which rotates together with the release lever 998. When the release lever 998 is rotated counterclockwise (to the solid line position) in FIG. 10, the release cams 9101 are rotated counterclockwise in FIG. 37 through the combination of the sector 9100 and the pinion 9102, and project into the cut paper supply path A1 for the cut paper. As a result, the forward ends of the release cams 9101 engage with the shaft part 450*a* of the tension roller 450. Then, the cams pull the tension roller 450 to the front side 993 to disengage the paper hold roller 415 from the platen 501. When the release lever 998 is turned clockwise in FIG. 10 (to the broken line position), the release cams 9101 retract from the front of the frame, allowing the cut paper to be transported.

The side frame 1023 is provided with a release detector 360 for detecting the position of the release lever 998. At the position (indicated by a broken line) of the release lever 998 when it is turned clockwise or in a state of the printer when the tractor unit 900 is not yet attached thereto, the protruded part 998*a* of the release lever is separated from the release detect lever 361. The release detector is stable at the contact ON position. It produces an H signal to the CPU mounted on the control board 1050. When the release lever 998 is turned counterclockwise (to the solid line position), the protruded part 998*a* of the release lever comes in contact with the release detect lever 361, to turn the release detect lever 361 up to the contact OFF position. Then, it outputs an L signal to the CPU mounted on the control board 1050. The CPU detects that the cut paper is transportable when it is an H signal, and that the continuous paper is transportable when it is an L signal.

The release mechanism described above is provided in the tractor unit. Accordingly, the size of the printer body is reduced. Further, since unnecessary parts are not assembled into the printer body, users who do not want the tractor unit as an optional unit may be provided with the printers at a low cost, i.e., not including the cost of the tractor unit.

Figure 37:
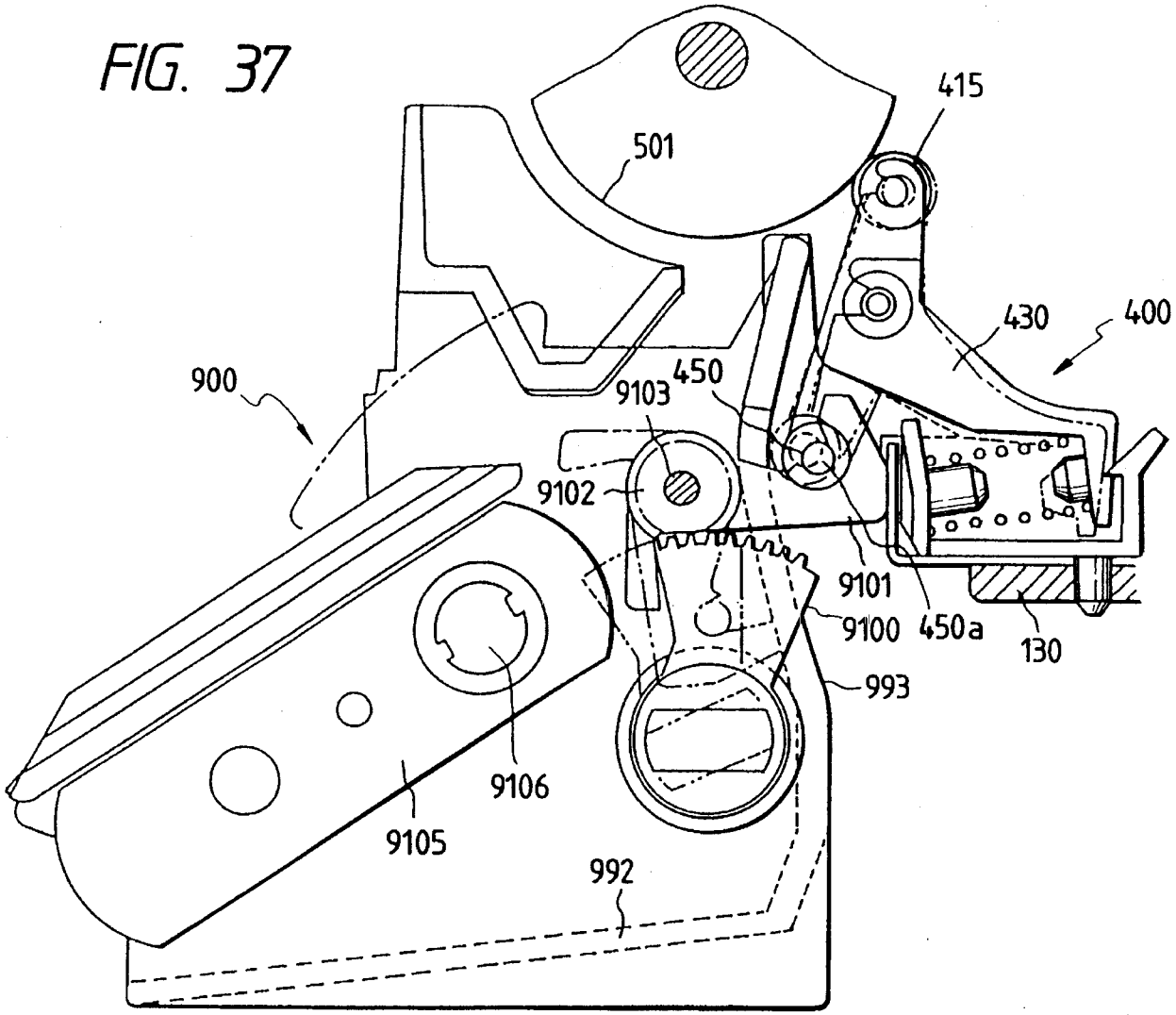
FIG. 37 is a left side view showing a tractor release mechanism.
Figure 38:
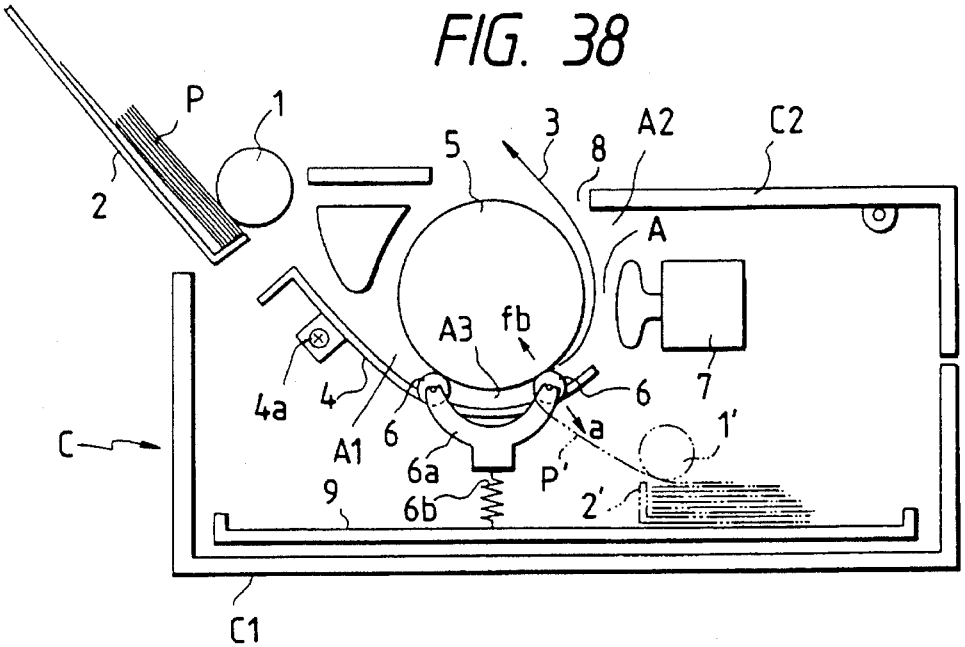
FIG. 38 is a side view showing an example of the conventional printer.

In FIGS. 36 and 37, reference numeral 9105 designates a push tractor; 9106, a drive shaft of the push tractor; 9110, a tractor supporter for guiding a continuous paper; 9111, a tractor guide shaft for guiding the tractor 9105 and the tractor supporter 9110.

The overall operation of the printer thus constructed will be described.

The operation of the printer when it prints on a cut paper sheet will first be described.

Figure 3:
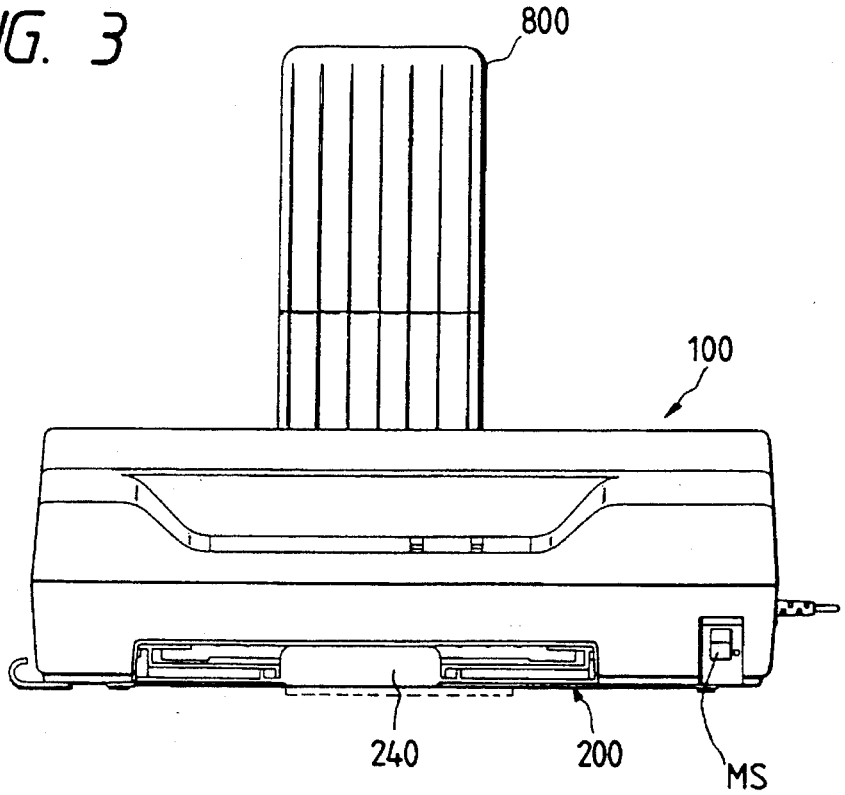
FIG. 3 is a front view showing the printer.
Figure 4:
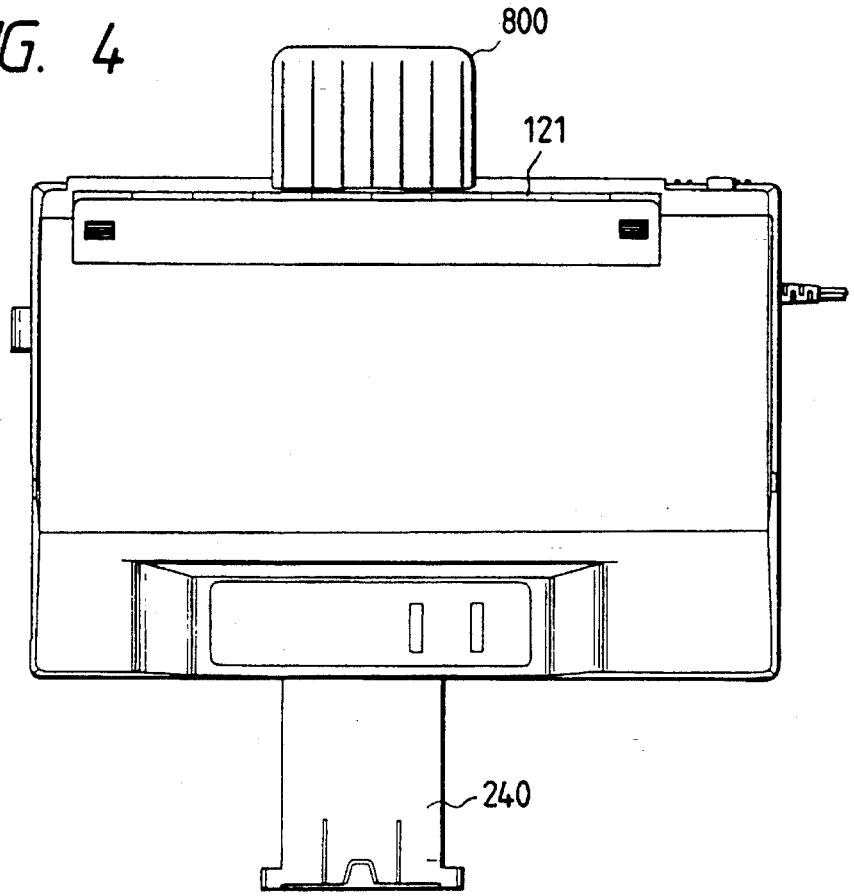
FIG. 4 is a plan view showing the printer.
Figure 5:
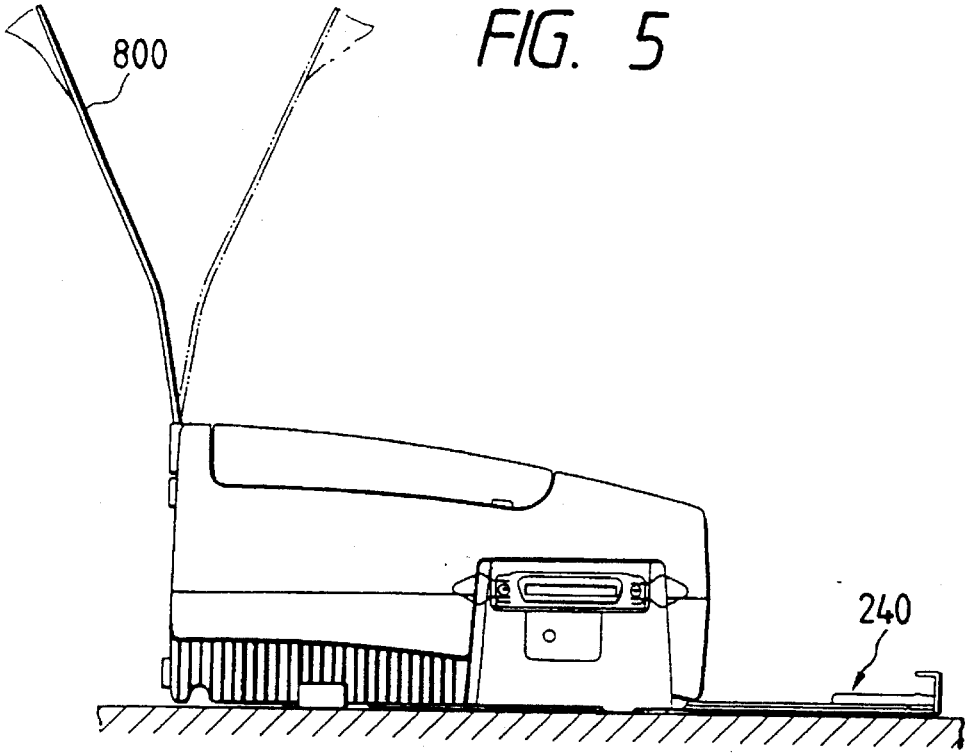
FIG. 5 is a left side view of the printer.

A main switch MS (see FIG. 3) is turned on. At this time, when the tractor unit 900 is not attached to the printer body or the release lever 998 of the tractor unit 900 has been turned to the position indicated by the broken line in FIG. 10, the release detector 360 outputs an H signal. Accordingly, the CPU detects that the cut paper is transportable. A predetermined operation of the printer for the cut paper is performed. The carriage 600 moves from the home position to a stand-by position. The idler 337, which is provided on one side of the carriage 600, is interlocked with the roller transmission gear 347 and the drive gear 351. The carriage is in a stand-by state.

Under this condition, in response to a print start signal, the drive motor 340 starts to turn in the reverse direction. In turn, the platen gear 345 engaging with the reduction pinion 343 reversely turns the platen 501 integral therewith. The roller transmission gear 347 transmits a rotation force to the drive gear 351, through the idler 337 on the carriage 600.

The sun gear 358 integral with the drive gear 351 turns the paper-feed roller gear 355 in the paper-feed direction. With the rotation torque generated, the paper-feed roller holder 356 is pivoted to the position indicated by the solid line in FIG. 1. As a result, the paper-feed roller 354 is pressed against the uppermost cut paper, and with the rotation force thereof, feeds the paper to the paper supply path A1 toward the platen 501.

The cut paper transported to the paper supply path A1 first turns the paper detect lever 481 (FIG. 17), and the paper detector 480 detects the passage of the cut paper. Then, it reaches the platen 501 rotating in the direction C2 and the paper hold roller 415, and stops there.

The subsequent paper-feed action of the paper-feed roller 354 deflects the forward end of the paper. As a result of the deflection of the paper, the leading edge of the paper is exactly positioned between the platen 501 and the paper hold roller 415.

Then, the printer operates in the following manner according to a preset program. The drive motor 340 forwardly rotates several steps so that the idler 337 smoothly disengages from the roller transmission gear 347 and the drive gear 351. In this case, the leading edge of the paper is fed approximately 2 mm in the forward direction. When the drive motor 340 stops, the carriage motor 641 operates to move, through the timing belt 642, the carriage 600 to the center in the print region in order to cause the carriage 600 to function as a paper bail. As a result, the drive force transmitted from the roller transmission gear 347 to the drive gear 351 is shut off, so that it is free.

Under this condition, the drive motor 340 forwardly turns again, and the platen 501 forwardly turns to feed the paper up to the print start position. At this time, the paper-feed roller 354 is pushed by the paper to turn clockwise in FIG. 1. The load for the paper feed motion is reduced, ensuring a precise printing operation.

The printed paper is transferred from the platen 501 to the discharge-paper roller 730, which in turn discharges the paper to the discharge tray 800.

To print visual information on a thick paper, for example, a postcard, the platen gap lever 634 is turned to the thick paper position (shown in FIG. 34(*b*)). The printer is placed upright as shown in FIG. 27. The thick paper is inserted into the printer by using the manual inserter guide 145. The printer is operated for printing. In this case, when the carriage is out of the home position, the detector 687 produces an H signal. From the signal, the CPU detects that the platen gap is set for the thick paper print, and continues the subsequent print operation to print visual information on the thick paper.

The operation of the printer when it prints a continuous paper will now be described. In this case, the tractor unit 900, in place of the first cover 140, is attached to the printer body. The release lever 998 is turned to the solid-line position in FIG. 10, to detach the paper hold roller 415 from the platen 501. Since an L signal has been produced from the release detector 360, the CPU detects that a continuous paper is transportable. Subsequently, the predetermined operation by the printer is continued for the continuous paper.

The continuous paper supplied from the tractor 9105 turns the second detect lever 930 (FIG. 17), and the detect lever 481 to cause the paper detector 480 to detect the paper. Then, the continuous paper travels to reach the platen surface without undergoing any impedance by the paper hold roller 415, and is printed while being moved forward by the platen.

To print visual information on the cut paper by using the printer with the tractor unit 900 attached thereto, all the user has to do is to turn the release lever 998 to the broken line position in FIG. 10. That is, when the release lever 998 is turned to the broken line position in FIG. 10, the transmission of a drive force by the release gear 996 to the tractor gear 995 is shut off. The release cam 9101 retracts from the paper supply path A1, while at the same time the paper hold roller 415 is pressed against the platen 501. Accordingly, the printer returns from the continuous paper mode to the cut paper mode.

What is claimed is:

1. A printer, comprising:

a roll-shaped platen;

a discharge roller for discharging paper that is fed by said platen;

a transfer roller located between said platen and said discharge roller; and a roller holder for rotatably supporting said discharge roller and said transfer roller, said roller holder including an elongated, curved opening for permitting said transfer roller to move in a planetary motion with respect to said platen, said transfer roller directly contacting said platen to move with respect to said platen in the planetary motion, said transfer roller contacting said discharge roller only when said platen rotates in the paper feed direction, said transfer roller transferring a rotating force of said platen to said discharge roller when said transfer roller contacts said discharge roller.

2. The printer according to claim 1, wherein said printer further comprises an upper and lower case and a tongue-like piece formed of an integral, one-piece construction with said upper case, said tongue-like piece resiliently urging said roller holder such that said transfer roller is normally biased toward said platen.

3. The printer according to claim 1, wherein said discharge roller is fixedly mounted on a discharge roller shaft and said transfer roller is fixedly mounted on a transfer roller shaft, each of said shafts including a gear, the gears being engaged when said platen rotates in the paper feed direction and disengaged when said platen rotates in a reverse direction due to the planetary motion of said transfer roller.

* * * * *